US006895860B2

(12) United States Patent
Mori

(10) Patent No.: US 6,895,860 B2
(45) Date of Patent: May 24, 2005

(54) PLANOGRAPHIC PRINTING PLATE PRECURSOR AND ITS FIXING METHOD ON PLATE CYLINDER

(75) Inventor: Takahiro Mori, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/811,110

(22) Filed: Mar. 26, 2004

(65) Prior Publication Data

US 2004/0180290 A1 Sep. 16, 2004

Related U.S. Application Data

(62) Division of application No. 10/456,240, filed on Jun. 5, 2003, now Pat. No. 6,796,236.

(30) Foreign Application Priority Data

Jun. 12, 2002 (JP) ..... 2002-171351

(51) Int. Cl.[7] ..... B41N 1/12

(52) U.S. Cl. ..... 101/460; 101/463.1; 430/302; 430/271.1

(58) Field of Search ..... 101/389.4, 401.1, 101/463.1, 460; 430/271.1, 302

(56) References Cited

U.S. PATENT DOCUMENTS 4,500,587 A 2/1985 Kamaishi et al.
4,833,985 A * 5/1989 Kojima et al. ..... 101/401.1
5,492,059 A * 2/1996 Reichel ..... 101/375
5,526,746 A * 6/1996 Capdeboscq ..... 101/415.1
5,550,002 A 8/1996 Kojima et al.
5,894,319 A * 4/1999 Okamura et al. ..... 347/264
6,077,646 A 6/2000 Verschueren et al.
6,114,094 A 9/2000 Ishiguro et al.
6,213,020 B1 * 4/2001 Kawada et al. ..... 101/486
6,251,563 B1 6/2001 Van Damme et al.
6,284,433 B1 9/2001 Ichikawa et al.
6,321,651 B1 * 11/2001 Tice et al. ..... 101/248
6,340,815 B1 1/2002 Verschueren et al.

FOREIGN PATENT DOCUMENTS

EP 1 038 666 A2 9/2000
EP 1 038 669 A1 9/2000

* cited by examiner

*Primary Examiner*—Andrew H. Hirshfeld
*Assistant Examiner*—Jill E. Culler
(74) *Attorney, Agent, or Firm*—Frishauf, Holtz, Goodman & Chick, P.C.

(57) ABSTRACT

A planographic printing plate precursor and its fixing method on a plate cylinder of a printing press are disclosed, the planographic printing plate precursor comprising a flexible substrate and provided thereon, an ink repellent layer or a hydrophilic layer wherein the planographic printing plate precursor has an 830 nm light transmittance of not less than 10%.

3 Claims, 1 Drawing Sheet

PLANOGRAPHIC PRINTING PLATE PRECURSOR AND ITS FIXING METHOD ON PLATE CYLINDER

This is a divisional application of Ser. No. 10/456,240, filed Jun. 5, 2003, now U.S. Pat. No. 6,796,236.

FIELD OF THE INVENTION

The present invention relates to a planographic printing plate precursor, and particularly to a planographic printing plate precursor capable of forming an image by a computer to plate (CTP) system and its fixing method on a plate cylinder.

BACKGROUND OF THE INVENTION

The printing plate precursor for CTP, which is inexpensive, can be easily handled, and has a printing ability comparable with that of a PS plate, is required accompanied with the digitization of printing data. Recently, a so-called processless printing plate precursor has been noticed which can be applied to a printing press employing a direct imaging (DI) process and does not require development by a special developing agent.

Herein, an outline of a printing press as one of the printing press employing a direct imaging (DI) process, disclosed in Japanese Patent O.P.I. Publication Nos. 5-77385, which is equipped with a plate cylinder, a pressure cylinder, an inking unit, and an image formation unit will be explained below employing FIG. 1.

FIG. 1 shows a schematic view of a printing press employing a processless printing plate precursor. Numerical number 1 shows a printing press. Numerical number 101 shows an image recording device, and numerical number 2 shows a printing section. The printing section 2 comprises an inking unit 201 and a dampening water unit 202. The inking unit 201 is an apparatus which supplies ink to a planographic printing plate precursor on which an image has been formed according to the image recording device 101 on a plate cylinder 102, and the dampening water unit 202 is an apparatus which supplies dampening water to the planographic printing plate precursor. Numerical number 102*a* shows a cramp for fixing a planographic printing plate precursor on the plate cylinder 102.

The plate cylinder 102 can be rotated by means of a driving device not illustrated such as a motor device not illustrated. A blanket cylinder 103, which receives an ink image formed on the planographic printing plate, is provided under the plate cylinder 102, and a pressure cylinder 104, which applies pressure to a paper sheet, and transfers to the paper sheet an ink image transferred on the blanket cylinder 103, is provided under the blanket cylinder 103. Numerical number 105 shows a paper sheet feeding section, numerical number 106 a chain gripper for transporting a paper sheet with the transferred image, and numerical number 107 a paper exit unit. Numerical number 108 shows an enclosure of the printing press 1, and numerical number 109 a paper sheet feeding device.

As a substrate of a planographic printing plate precursor as a processless plate precursor applied to a printing press having the DI capability, the same aluminum plate as used in a conventional PS plate is considered, but processless plate precursor employing a flexible substrate is sought in view of freedom of the precursor constitution, cost reduction, and adaptability to full automation of the DI printing press.

A DI printing press QUICK MASTER 46DI produced by Heiderberg Co., Ltd. holds a planographic printing plate precursor employing a flexible substrate in the roll form on the unrolling spool side within the plate cylinder, unrolls the precursor to supply it on the plate cylinder, and winds the precursor around the winding spool within the plate cylinder, whereby the plate precursor is changed to another plate precursor.

In the above printing press, the precursor is fixed on the plate cylinder by applying tension to the precursor between the unrolling spool and the winding spool, as disclosed in Japanese Patent O.P.I. Publication No. 7-101044.

Since the planographic printing plate precursor exclusive for the DI printing press QUICK MASTER 46DI has a thickness of 200 $\mu$m, such a tension neither elongates nor displaces the precursor. However, only a short length of a planographic printing plate precursor, i.e., 30 by plate number, can be held in the roll form within the plate cylinder due to its large thickness.

A DI printing press is suitable for printing a small volume of copies. Therefore, the planographic printing plate precursor for it is used up in a short time, and a frequency of exchange to a new a planographic printing plate precursor roll is high. Reduction of the thickness of a planographic printing plate precursor can lengthen a planographic printing plate precursor in the roll form held within the plate cylinder, and can also contribute to cost reduction of the planographic printing plate precursor. However, a conventional method of fixing a planographic printing plate precursor on a plate cylinder of a printing press has problems in that elongation and displacement of a planographic printing plate precursor occurs during printing.

As a method of fixing a thinner printing plate precursor on a plate cylinder of a printing press, various methods are proposed in Japanese Patent O.P.I. Publication No. 11-28802. One of the methods is a method which provides a printing plate precursor on a plate cylinder having suction orifices uniformly distributed in the surface and sucks air through the orifices to fix the printing plate precursor on the plate cylinder under reduced pressure. However, reduction of the printing plate precursor thickness causes impermissible deformation at the orifice portions which may result in lowering of image quality and printing quality. In order to prevent such a deformation, a method is proposed which reduces a diameter of the orifices to for example, not more than 1 $\mu$m, however, such small orifices increase loss of applied pressure, and are difficult to effectively fix the printing plate precursor on the plate cylinder.

Another one is a method employing a planographic printing plate precursor having on the rear surface a heat sensitive adhesion layer whose adhesion force is reduced by heat application.

In this method such a planographic printing plate precursor is fixed through the adhesion layer on a plate cylinder having a heating means capable of heating the plate cylinder surface so that the heat sensitive layer is in contact with the plate cylinder, and after completion of printing, the plate cylinder surface is heated to reduce the adhesion force of the heat sensitive adhesion layer whereby the planographic printing plate is peeled from the plate cylinder. However, this method has problem in that after peeling of a planographic printing plate used for printing, the adhesive layer remains on the surface of the plate cylinder. Particularly in a DI printing press frequently exchanging a planographic printing plate precursor, the adhesion layer is piled on the plate cylinder surface, resulting in a serious problem.

In order to completely remove such a adhesion layer remaining on the plate cylinder surface, the plate cylinder surface is washed through a cleaner. This not only prolongs time for planographic printing plate precursor exchange but also brings about cost increase due to use of consumables.

As a method for heating the plate cylinder surface, a method employing a heater is proposed. The heater cannot promptly elevate temperature of the plate cylinder surface in view of the heat content of the whole plate cylinder. This requires standby until the plate cylinder surface elevates to a predetermined temperature, resulting in prolongation of time for planographic printing plate precursor exchange.

As described above, the planographic printing plate precursor fixing methods proposed so far are not satisfactory, and a method has not been developed which firmly fixes on a plate cylinder without being out of position a thinner planographic printing plate precursor, which is suitable particularly for full automation or labor saving of a DI printing press.

SUMMARY OF THE INVENTION

The present invention has been made in view of the above. An object of the invention is to provide a planographic printing plate precursor applicable for CTP, which does not require development by a special developing agent, and a method for fixing the planographic printing plate precursor on a plate cylinder of a printing press. Another object of the invention is to provide a planographic printing plate precursor having a flexible substrate with a reduced thickness, which is capable of fixing on a plate cylinder of a printing press without displacement and a method for fixing the planographic printing plate precursor on a plate cylinder of a printing press. Sill another object of the invention is to provide a planographic printing plate applicable to a DI printing press and a method for fixing the planographic printing plate precursor on a plate cylinder of the printing press.

DETAILED DESCRIPTION OF THE INVENTION

Figure 1:
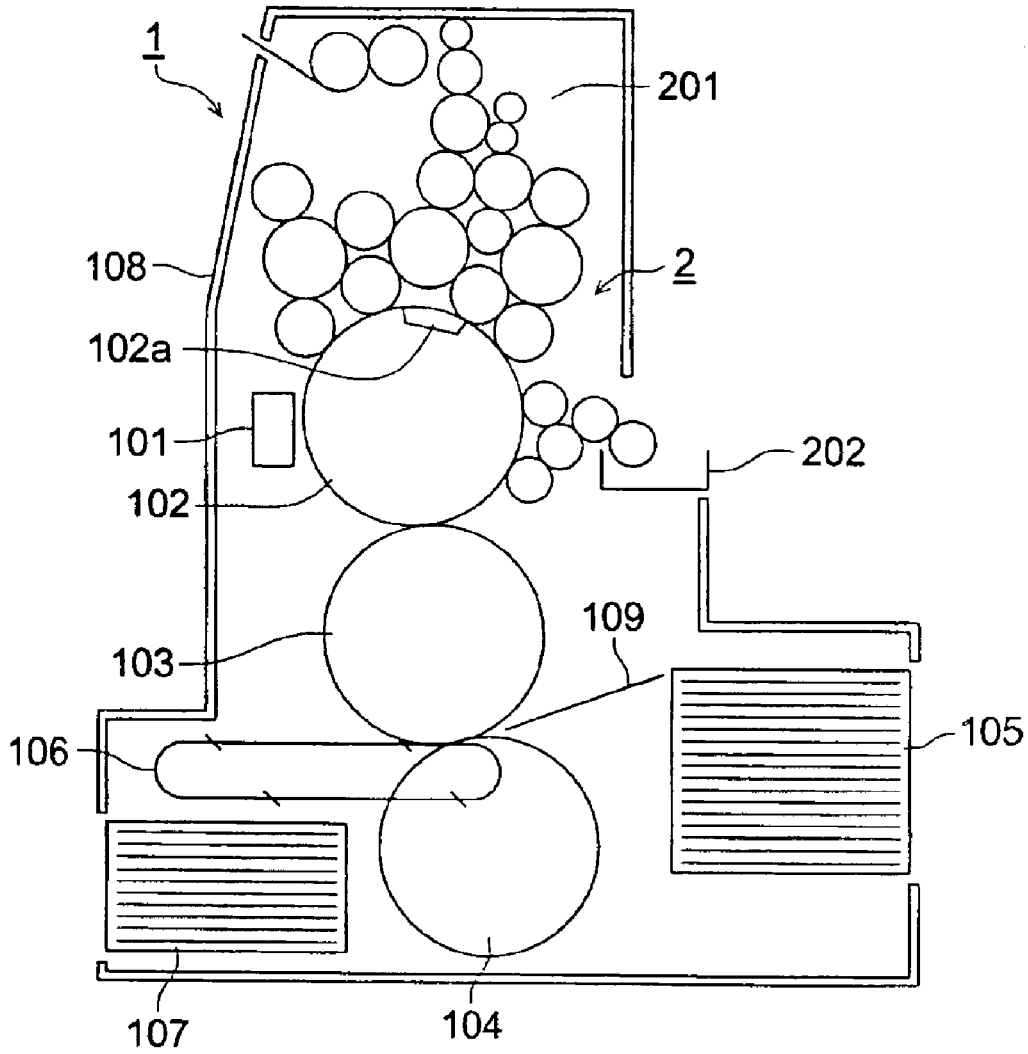
FIG. 1 shows a schematic view of a printing press employing a processless printing plate precursor.

The above object of the invention has been attained by the following constitution:

1-1. A planographic printing plate precursor comprising a flexible substrate and provided thereon, an ink repellent layer or a hydrophilic layer wherein the planographic printing plate precursor has an 830 nm light transmittance of not less than 10%.

1-2. The planographic printing plate precursor of item 1-1 above, wherein the surface roughness Ra of the outermost surface of the planographic printing plate precursor opposite the ink repellent layer or the hydrophilic layer is from 0.1 $\mu$m to less than 2 $\mu$m.

1-3. The planographic printing plate precursor of item 1-1 above, wherein a back coat layer is provided on the surface of the flexible substrate opposite the ink repellent layer or the hydrophilic layer, and is an outermost layer.

1-4. The planographic printing plate precursor of item 1-3 above, wherein the back coat layer contains a light heat conversion material.

1-5. The planographic printing plate precursor of item 1-3 above, wherein the back coat layer contains a thermoplastic material.

1-6. The planographic printing plate precursor of item 1-3 above, wherein the back coat layer has adhesion force such that when the back coat layer is caused to adhere to a glass plate surface at a pressure of 10 g/cm$^2$ at 25° C. for 10 minutes, and then peeled from the glass plate, the peeling force necessary to peel the back coat layer is not more than 10 g/cm.

1-7. The planographic printing plate precursor of item 1-3 above, wherein the back coat layer has a surface roughness Ra of from 0.1 $\mu$m to less than 2 $\mu$m.

1-8. The planographic printing plate precursor of item 1-1 above, wherein at least one layer on the ink repellent layer or the hydrophilic layer side contains a light heat conversion material 1-9. The planographic printing plate precursor of item 1-1 above, wherein the thickness of the flexible substrate is from 10 to 25 $\mu$m.

1-10. A method of fixing a planographic printing plate precursor on a plate cylinder of a printing press capable of forming an image on the plate cylinder, the surface of the plate cylinder having orifices or grooves to obtain reduced pressure by suction, existing only at a portion corresponding to the peripheral portion of an image formation region in the planographic printing plate precursor, the method comprising the steps of mounting the planographic printing plate precursor on the plate cylinder, and applying suction to the planographic printing plate precursor through the orifices or grooves to fix the planographic printing plate precursor on the surface of the plate cylinder.

1-11. The method of item 1-10 above, wherein the peripheral portion is outside register marks.

1-12. The method of item 1-10 above, wherein the planographic printing plate precursor is the planographic printing plate precursor of item 8 above.

1-13. A method of fixing a planographic printing plate precursor, comprising a flexible substrate and provided thereon, an ink repellent layer or a hydrophilic layer, on a plate cylinder of a printing press capable of forming an image on the plate cylinder, the method comprising the steps of mounting the planographic printing plate precursor on the plate cylinder so that the surface of the planographic printing plate precursor opposite the ink repellent layer or hydrophilic layer faces the plate cylinder, providing a layer having a light heat conversion function between the planographic printing plate precursor and the plate cylinder, and exposing the planographic printing plate precursor employing infrared to near infrared light from the ink repellent layer or hydrophilic layer side to heat the layer having a light heat conversion function due to light heat conversion, whereby the planographic printing plate precursor is fixed on the plate cylinder.

1-14. The method of item 1-13 above, the surface of the plate cylinder has orifices or grooves, wherein the method further comprises applying suction to the planographic printing plate precursor through the orifices or grooves.

1-15. The method of item 1-13 above, wherein the layer having a light heat conversion function is provided on the surface of the plate cylinder, and an outermost surface of the planographic printing plate precursor opposite the ink repellent layer or hydrophilic layer has a surface roughness Ra of 0.1 to less than 2 $\mu$m.

1-16. The method of item 1-13 above, wherein the surface of the plate cylinder has a surface roughness Ra of 0.1 to less than 2 $\mu$m.

1-17. The method of item 1-16 above, wherein the layer having a light heat conversion function is provided as an outermost layer on the surface of the planographic printing plate precursor opposite the ink repellent layer or hydrophilic layer.

1-18. The method of item 1-13 above, wherein the infrared to near infrared light is an infrared to near infrared laser.

1-19. The method of item 1-18 above, wherein the exposing is carried out so that the light is brought into focus on the surface of the planographic printing plate precursor opposite the hydrophilic layer or ink repellent layer or its vicinity.

1-20. The method of item 1-10 above, wherein the plate cylinder surface is comprised of a detachable material.

2-1. A planographic printing plate precursor comprising a flexible substrate and provided thereon, an ink repellent layer or a hydrophilic layer wherein the planographic printing plate precursor has an 830 nm light transmittance of not less than 10%.

2-2. The planographic printing plate precursor of item 2-1 above, wherein the surface roughness Ra of the surface of the flexible substrate opposite the ink repellent layer or the hydrophilic layer is from 0.1 $\mu$m to less than 2 $\mu$m.

2-3. The planographic printing plate precursor of item 2-1 above, wherein a back coat layer is provided on the surface of the flexible substrate opposite the ink repellent layer or the hydrophilic layer.

2-4. The planographic printing plate precursor of item 2-3 above, wherein the back coat layer contains a light heat conversion material.

2-5. The planographic printing plate precursor of item 2-3 or 2-4 above, wherein the back coat layer contains a thermoplastic material.

2-6. The planographic printing plate precursor of any one of items 2-3 through 2-5 above, wherein the back coat layer has neither adhesion property nor sticking property at 25° C.

2-7. The planographic printing plate precursor of any one of items 2-3 through 2-6 above, wherein the back coat layer has a surface roughness Ra of from 0.1 $\mu$m to less than 2 $\mu$m.

2-8. The planographic printing plate precursor of any one of items 2-1 through 2-7 above, wherein at least one layer on the ink repellent layer or the hydrophilic layer side contains a light heat conversion material 2-9. The planographic printing plate precursor of any one of items 2-1 through 2-8 above, wherein the thickness of the flexible substrate is from 10 to 25 $\mu$m.

2-10. A method of fixing a planographic printing plate precursor on a plate cylinder of a printing press capable of forming an image on the plate cylinder, the surface of the plate cylinder having orifices or grooves to obtain reduced pressure by suction, existing only at a portion corresponding to the peripheral portion of an image formation region in the planographic printing plate precursor, the method comprising the steps of mounting the planographic printing plate precursor on the plate cylinder, and applying suction to the orifices or grooves to fix the printing plate precursor on the surface of the plate cylinder.

2-11. The method of item 2-10 above, wherein the peripheral portion is outside register marks.

2-12. The method of item 2-10 above, wherein the planographic printing plate precursor is the planographic printing plate precursor of item 2-8 above.

2-13. A method of fixing a planographic printing plate precursor, comprising a flexible substrate and provided thereon, an ink repellent layer or a hydrophilic layer, on a plate cylinder of a printing press capable of forming an image on the plate cylinder, the method comprising the steps of mounting the printing plate precursor on the plate cylinder so that the surface of the substrate opposite the ink repellent layer or hydrophilic layer faces the plate cylinder, a layer having a light heat conversion function being provided between the printing plate precursor and the plate cylinder, and exposing the printing plate precursor employing infrared to near infrared light from the ink repellent layer or hydrophilic layer side to heat the layer having a light heat conversion function due to light heat conversion.

2-14. The method of item 2-13 above, wherein the surface of the plate cylinder has orifices or grooves to obtain a reduced pressure by suction.

2-15. The method of item 2-13 or 2-14 above, wherein the layer having a light heat conversion function is a thermoplastic layer is provided on the surface of the plate cylinder, and the surface of the substrate opposite the ink repellent layer or hydrophilic layer has a surface roughness Ra of 0.1 to less than 2 $\mu$m.

2-16. The method of item 2-13 or 2-14 above, wherein the surface of the plate cylinder has an average surface roughness of 0.1 to less than 2 $\mu$m, and the thermoplastic layer is provided on the surface of the substrate opposite the ink repellent layer or hydrophilic layer.

2-17. The method of any one of items 2-13 through 2-16 above, wherein the infrared to near infrared light is an infrared to near infrared laser.

2-18. The method of any one of items 2-13 through 2-17 above, wherein the exposing is carried out so that the light is brought into focus on the interface between the plate cylinder surface and the planographic printing plate precursor or its vicinity.

2-19. The method of any one of items 2-10 through 2-16 above, wherein the plate cylinder surface has a detachable support.

2-20. The method of any one of items 2-10 through 2-16 above, wherein the plate cylinder is a plate cylinder of a printing press equipped with an image formation device.

(Planographic Printing Plate Precursor)

The planographic printing plate precursor of the invention (hereinafter also referred to as printing plate precursor) comprises a flexible substrate and provided on one side of the substrate, a hydrophilic layer or an ink repellent layer and the printing plate precursor has an 830 nm light transmittance of not less than 0.1. The upper limit of the transmittance is not specifically limited, but the higher upper limit is preferred.

The planographic printing plate precursor is suitable as one which is fixed on a plate cylinder of a printing press. The printing plate precursor is fixed on the plate cylinder so that the surface (hereinafter referred to as rear surface) of the planographic printing plate precursor opposite the hydrophilic layer or the ink repellent layer faces the plate cylinder surface, and exposed so that infrared to near-infrared light irradiated from the hydrophilic layer or the ink repellent layer side reaches the rear surface of the planographic printing plate precursor or its vicinity. Therefore, the 830 nm light transmittance of the planographic printing plate precursor is preferably from 10 to 100%, more preferably not less than 30%, and still more preferably not less than 50%.

Herein, the 830 nm light transmittance of the planographic printing plate precursor is measured employing a conventional spectrophotometer capable of measuring transmittance of light with wavelengths of infrared regions, for example, U-3300 produced by Hitachi Co., Ltd.

The infrared to near-infrared light described above means a light with a wavelength of from 700 to 1500 nm. The infrared to near-infrared light acts on a layer having light heat conversion function to generate heat.

The planographic printing plate precursor having a hydrophilic layer is used in the conventional printing employing dampening water. The planographic printing plate precursor having an ink repellent layer is used in the unconventional waterless printing.

The planographic printing plate precursor can comprise a layer containing a light heat conversion material on the side of the hydrophilic layer or ink repellent layer, as long as the planographic printing plate precursor has an 830 nm light transmittance of not less than 0.1.

The planographic printing plate precursor capable of forming an image employing an infrared to near-infrared light is preferred, since both imagewise exposure and its fixation on a plate cylinder can be carried out employing for example, a 830 nm semi-conductor laser.

An image can be preferably formed by applying an oleophilic ink or an oleophilic radiation-curable ink onto the hydrophilic layer by means of an ink jet method, wherein a flash lamp such as a xenon lamp is preferably used for fixation of the printing plate precursor onto a plate cylinder.

The total thickness of the planographic printing plate precursor is preferably less. The thickness of the flexible substrate is preferably not more than 25 μm, more preferably from 10 to 25 μm, and still more preferably from 10 to 20 μm.

When the planographic printing plate precursor of the invention is fixed onto the plate cylinder according to a method described later, even if the substrate with a thickness of from 10 to 25 μm is employed, sufficient performance is obtained and neither elongation nor replacement of the printing plate precursor occurs.

A substrate having a thickness exceeding 25 μm can be also used, although it increases cost of the substrate itself. However, a substrate with a thickness of from 10 to 25 μm is preferably used in view of handling property at its manufacturing or usage stage or its cost.

(Substrate)

As the flexible substrate in the invention (hereinafter also referred to simply as the substrate), those well known in the art as substrates for printing plates can be used. Examples of the substrate include a thin metal plate, a plastic film, paper treated with polyolefin, and composite materials such as laminates thereof.

Examples of the plastic film include a polyethylene terephthalate film, a polyethylene naphthalate film, a polyimide film, a polyamide film, a polycarbonate film, a polysulfone film, a polyphenylene oxide film, and a cellulose ester film. The plastic film is preferably a polyethylene terephthalate film, or a polyethylene naphthalate film. In order to increase adhesion between the substrate and a coating layer, it is preferred that the surface of the plastic film is subjected to adhesion increasing treatment or is coated with a subbing layer. Examples of the adhesion increasing treatment include corona discharge treatment, flame treatment, plasma treatment and UV light irradiation treatment. The subbing layers include a layer containing gelatin or latex.

The substrate may be subjected to known treatment in order to enhance its strength or dimensional stability.

The surface of the substrate opposite the hydrophilic layer or the ink repellent layer has an average surface roughness Ra of preferably from 0.1 to less than 2 μm.

The planographic printing plate precursor comprising a substrate with the above surface roughness range is preferred in that its transportability is good, scratches on the hydrophilic layer or the ink repellent layer are difficult to be produced when it is wound in the roll form, and its printing durability is improved.

As a substrate having a surface roughness described above as a surface roughness of the rear surface there is, for example, a PET film containing known fillers. A known PET film having the surface roughness only on one side is also preferably used which is obtained by co-extruding a material containing no fillers and a material containing fillers on a support and stretching the extruded material.

(Layer Structure)

The planographic printing plate precursor of the invention comprises a substrate and provided thereon, a hydrophilic layer or an ink repellent layer as a fundamental structure. The planographic printing plate precursor may have another layer for example, an under layer which is provided between the hydrophilic layer and the ink repellent layer. Further, the planographic printing plate precursor may have an overcoat layer on the rear surface of the substrate.

(Back Coat Layer)

The planographic printing plate precursor of the invention may have a back coat layer on the rear surface of the substrate. The back coat layer preferably contains a light heat conversion material so as to have light heat conversion function. Examples of the light heat conversion material include compounds describe below. The light heat conversion material content of the back coat layer is preferably 0.1 to 50% by weight.

A binder contained in the back coat layer is not specifically limited, and the known compounds can be used as the binder. The binder is preferably a compound forming a layer without tackiness.

As the binder used in the back coat layer there is a conventional thermoplastic polymer. Preferred examples of the thermoplastic polymer include an ethylene copolymer, a polyamide resin, a polyester resin, a polyurethane resin, a polyolefin resin, an acryl resin, a vinyl chloride resin, a cellulose resin, a rosin resin, a polyvinyl alcohol resin, a polyvinyl acetal resin, an ionomer resin, a petroleum resin, elastomers such as natural rubber, styrene-butadiene rubber, isoprene rubber, chloroprene rubber, or a diene polymer, ester rubber, a rosin derivative such as a rosin-maleic acid resin, a rosin-phenol resin, or a hydrogenated rosin, a phenol resin, a terpene resin, a cyclopentadiene resin, an aromatic hydrocarbon resin.

The back coat layer may contain an organic or inorganic filler, a lubricant, a surfactant or a cross-linking agent.

In the planographic printing plate precursor with the back coat layer, the back coat layer is preferably one capable of enhancing function fixing the printing plate precursor onto a plate cylinder of a printing press, by heat generated in the back coat layer containing a light heat conversion material when the precursor is subjected to infrared or near infrared laser exposure from the front surface of the precursor (the hydrophilic layer or ink repellent layer side).

Accordingly, the back coat layer is preferably thermoplastic. As described later, plastic deformation is preferably caused at the interface between a planographic printing plate precursor and a plate cylinder by heat generation described above.

The heat generation herein refers to a temperature elevation up to 40° C. or more, preferably up to 60° C. or more, and more preferably up to 80° C. or more. The upper limit of the temperature elevation is not specifically limited, but is preferably 400° C., and more preferably 300° C.

Temperature initiating plastic deformation is preferably not less than 60° C., and more preferably not less than 80° C. Such temperature is preferred in that the back coat layer can be deformed only on heating without lowering stability of the planographic printing plate precursor. In this case, Tg of a thermoplastic polymer contained in the back coating layer may be less than 60° C. The thermoplasticity of the back coating layer may be controlled by an appropriate combination of the polymer and other materials. The other materials include a known binder, metal particles (including metal particle dispersion) represented by colloidal silica particles described later, a mold releasing agent, a lubricant, a surfactant, and the above-described light heat conversion material.

It is preferred that the back coat layer has neither adhesion property nor sticking property at 25° C., since a planographic printing plate after printing can be removed from the plate cylinder of a printing press so that the back coating layer does not remain on the plate cylinder surface.

Herein, "the back coat layer has neither adhesion property nor sticking property at 25° C." means that when the back coat layer is caused to adhere to a glass plate surface at a pressure of 10 g/cm$^2$ at 25° C. for 10 minutes, and then peeled from the glass plate, the peeling force necessary to peel the back coat layer is not more than 10 g/cm. The peeling force is preferably not more than 5 g/cm.

The average surface roughness Ra of the back coating layer is preferably from 0.1 to less than 2 $\mu$m on the same reason as the definition of Ra of the rear surface of the substrate.

In order to obtain such an average surface roughness, an appropriate filler can be incorporated into the back coating layer as described above. For example, inorganic or organic particles with a particle size of not less than 1 $\mu$m can be incorporated into the back coating layer in order to control the surface roughness of the back coating layer.

(Fixing Method of a Planographic Printing Plate Precursor on a Plate Cylinder of a Printing Press)

The method (hereinafter referred to also as the method of the invention) of fixing a planographic printing plate precursor relates to a method of fixing a planographic printing plate precursor on a plate cylinder of a printing press capable of forming an image on the plate cylinder. In this method, a layer having a light heat conversion function is preferably provided between the printing plate precursor and the plate cylinder. It is preferred that the printing plate precursor be exposed employing infrared to near infrared light from the ink repellent layer or hydrophilic layer to heat the layer having a light heat conversion function and fixed onto the plate cylinder.

Herein, it is preferred that the surface of the plate cylinder has a thermoplastic layer having a light heat conversion function and the rear surface of the planographic printing plate precursor has an average surface roughness of 0.1 to less than 2 $\mu$m.

It is also preferred that the surface of the plate cylinder has an average surface roughness Ra of 0.1 to less than 2 $\mu$m, and a thermoplastic back coating layer is provided on the surface of the substrate opposite the ink repellent layer or hydrophilic layer of the a planographic printing plate precursor.

It is also preferred in the invention that the surface of the plate cylinder has orifices or grooves so that the planographic printing plate precursor is fixed on the plate cylinder under a pressure reduced pressure by suction.

The orifices or grooves to obtain a reduced pressure by suction preferably exist only at a portion corresponding to the peripheral portion of an image formation region in the planographic printing plate precursor. The peripheral portion is preferably outside register marks. The peripheral portion is preferably a margin between a line, which is distant from each of the ends of the planographic printing plate precursor by preferably 20 mm and more preferably 30 mm, and each of the planographic printing plate precursor ends.

The method of the invention provides more excellent results employing the planographic printing plate precursor of the invention.

The infrared to near infrared light described above may be laser light or other light, and is preferably laser beams.

The laser exposure is carried out so that the laser light is brought into focus on the interface between the plate cylinder surface and the planographic printing plate precursor or its vicinity, whereby the layer having a light heat conversion material function can be heated to fix the plate precursor onto the plate cylinder.

The plate cylinder surface has a detachable support, and it is preferred that the plate cylinder having a detachable support is a plate cylinder of a printing press and the printing press is equipped with an image formation device.

In the invention, the back coating layer of the planographic printing plate precursor and the layer having a light heat conversion material function formed on the plate cylinder surface preferably have the surface roughness Ra described above, and more preferably have a surface protrusion density of preferably 10 to 10,000 per m$^2$, and more preferably 100 to 3000 per m$^2$. Such a surface protrusion density is preferred in enhancing the fixing effect of the planographic printing plate precursor.

The back coating layer of the planographic printing plate precursor and the layer having a light heat conversion material function formed on the plate cylinder surface have a thickness of preferably from 0.1 to 5 $\mu$m, and more preferably from 0.5 to 3 $\mu$m. Such a layer thickness is preferred in enhancing the fixing effect of the planographic printing plate precursor or in ease of peeling a printing plate after printing from the plate cylinder.

(Hydrophilic Layer)

Materials used in the hydrophilic layer of the printing plate precursor of the invention include materials forming a hydrophilic matrix phase such as porous silica particles or porous aluminosilicate particles, layer structural clay mineral particles, an aqueous silicate solution, a water soluble resin, a cationic resin, a light heat conversion material, and particles covered with an inorganic or organic substance. The hydrophilic layer preferably contains these materials.

Material for forming a hydrophilic matrix phase in the hydrophilic layer is preferably a metal oxide. The metal oxide preferably comprises metal oxide particles. Examples of the metal oxide particles include colloidal silica particles, an alumina sol, a titania sol and another metal oxide sol. The metal oxide particles may have any shape such as spherical, needle-like, and feather-like shape. The average particle size is preferably from 3 to 100 nm (herein, the particle size represents a diameter when the particles are spherical, a major axis length when the particles are needle-like, an outside diameter when the particles are feather-like, and the maximum diameter when the particles are in the other forms), and plural kinds of metal oxide each having a different size may be used in combination. The surface of the particles may be subjected to surface treatment.

The metal oxide particles can be used as a binder, utilizing its layer forming ability. The metal oxide particles are suitably used in a hydrophilic layer since they minimize lowering of the hydrophilicity of the layer as compared with an organic compound binder. Among the above-mentioned, colloidal silica is particularly preferred. The colloidal silica has a high layer forming ability under a drying condition with a relative low temperature, and can provide a good layer strength. It is preferred that the colloidal silica used in the invention is necklace-shaped colloidal silica or colloidal silica particles having an average particle size of not more than 20 nm, each being described later. Further, it is preferred that the colloidal silica provides an alkaline colloidal silica solution as a colloid solution.

The necklace-shaped colloidal silica to be used in the invention is a generic term of an aqueous dispersion system of spherical silica having a primary particle size of the order of nm. The necklace-shaped colloidal silica to be used in the invention means a "pearl necklace-shaped" colloidal silica formed by connecting spherical colloidal silica particles each having a primary particle size of from 10 to 50 μm so as to attain a length of from 50 to 400 nm. The term of "pearl necklace-shaped" means that the image of connected colloidal silica particles is like to the shape of a pearl necklace. The bonding between the silica particles forming the necklace-shaped colloidal silica is considered to be —Si—O—Si—, which is formed by dehydration of —SiOH groups located on the surface of the silica particles. Concrete examples of the necklace-shaped colloidal silica include Snowtex-PS series produced by Nissan Kagaku Kogyo, Co., Ltd.

As the products, there are Snowtex-PS-S (the average particle size in the connected state is approximately 110 nm), Snowtex-PS-M (the average particle size in the connected state is approximately 120 nm) and Snowtex-PS-L (the average particle size in the connected state is approximately 170 nm). Acidic colloidal silicas corresponding to each of the above-mentioned are Snowtex-PS-S-O, Snowtex-PS-M-O and Snowtex-PS-L-O, respectively.

The necklace-shaped colloidal silica is preferably used in a hydrophilic layer as a porosity providing material for hydrophilic matrix phase, and porosity and strength of the layer can be secured by its addition to the layer. Among them, the use of Snowtex-PS-S, Snowtex-PS-M or Snowtex-PS-L, each being alkaline colloidal silica particles, is particularly preferable since the strength of the hydrophilic layer is increased and occurrence of background contamination is inhibited even when a lot of prints are printed.

It is known that the binding force of the colloidal silica particles is become larger with decrease of the particle size. The average particle size of the colloidal silica particles to be used in the invention is preferably not more than 20 nm, and more preferably 3 to 15 nm. As above-mentioned, the alkaline colloidal silica particles show the effect of inhibiting occurrence of the background contamination. Accordingly, the use of the alkaline colloidal silica particles is particularly preferable.

Examples of the alkaline colloidal silica particles having the average particle size within the foregoing range include Snowtex-20 (average particle size: 10 to 20 nm), Snowtex-30 (average particle size: 10 to 20 nm), Snowtex-40 (average particle size: 10 to 20 nm), Snowtex-N (average particle size: 10 to 20 nm), Snowtex-S (average particle size: 8 to 11 nm) and Snowtex-XS (average particle size: 4 to 6 nm), each produced by Nissan Kagaku Co., Ltd.

The colloidal silica particles having an average particle size of not more than 20 nm, when used together with the necklace-shaped colloidal silica as described above, is particularly preferred, since porosity of the layer is maintained and the layer strength is further increased.

The ratio of the colloidal silica particles having an average particle size of not more than 20 nm to the necklace-shaped colloidal silica is preferably from 95/5 to 5/95, more preferably from 70/30 to 20/80, and most preferably from 60/40 to 30/70.

The hydrophilic layer of the printing plate precursor of the invention contains porous metal oxide particles as metal oxides. Examples of the porous metal oxide particles include porous silica particles, porous aluminosilicate particles or zeolite particles as described later. Porous silica or porous aluminosilicate particles The porous silica particles are ordinarily produced by a wet method or a dry method. By the wet method, the porous silica particles can be obtained by drying and pulverizing a gel prepared by neutralizing an aqueous silicate solution, or pulverizing the precipitate formed by neutralization. By the dry method, the porous silica particles are prepared by combustion of silicon tetrachloride together with hydrogen and oxygen to precipitate silica. The porosity and the particle size of such particles can be controlled by variation of the production conditions.

The porous silica particles prepared from the gel by the wet method is particularly preferred.

The porous aluminosilicate particles can be prepared by the method described in, for example, JP O.P.I. No. 10-71764. Thus prepared aluminosilicate particles are amorphous complex particles synthesized by hydrolysis of aluminum alkoxide and silicon alkoxide as the major components. The particles can be synthesized so that the ratio of alumina to silica in the particles is within the range of from 1:4 to 4:1. Complex particles composed of three or more components prepared by an addition of another metal alkoxide may also be used in the invention. In such a particle, the porosity and the particle size can be controlled by adjustment of the production conditions.

The porosity of the particles is preferably not less than 1.0 ml/g, more preferably not less than 1.2 ml/g, and most preferably of from 1.8 to 2.5 ml/g, in terms of pore volume before the dispersion. The pore volume is closely related to water retention of the coated layer. As the pore volume increases, the water retention is increased, contamination is difficult to occur, and the water retention latitude is broad. Particles having a pore volume of more than 2.5 ml/g are brittle, resulting in lowering of durability of the layer containing them. Particles having a pore volume of less than 0.5 ml/g may be insufficient in printing performance.

<Zeolite Particles>

Zeolite is a crystalline aluminosilicate, which is a porous material having voids of a regular three dimensional net work structure and having a pore size of 0.3 to 1 nm. Natural and synthetic zeolites are expressed by the following formula.

$$(M_1.(M_2)_{0.5})_m(Al_mSi_nO_{2(m+n)}).xH_2O$$

In the above, $M_1$ and $M_2$ are each exchangeable cations. Examples of $M_1$ or $M_2$ include $Li^+$, $Na^+$, $K^+$, $Tl^+$, $Me_4N^+$ (TMA), $Et_4N^+$ (TEA), $Pr_4N^+$ (TPA), $C_7H_{15}N^{2+}$, and $C_8H_{16}N^+$, and examples of $M^2$ include $Ca^{2+}$, $Mg^{2+}$, $Ba^{2+}$, $Sr^{2+}$ and $(C_8H_{18}N)_2^{2+}$. Relation of n and m is n≧m, and consequently, the ratio of m/n, or that of Al/Si is not more than 1. A higher Al/Si ratio shows a higher content of the exchangeable cation, and a higher polarity, resulting in higher hydrophilicity. The Al/Si ratio is within the range of preferably from 0.4 to 1.0, and more preferably 0.8 to 1.0. x is an integer.

Synthetic zeolite having a stable Al/Si ratio and a sharp particle size distribution is preferably used as the zeolite particles to be used in the invention. Examples of such zeolite include Zeolite A: $Na_{12}(Al_{12}Si_{12}O_{48}).27H_2O$; Al/Si=1.0, Zeolite X: $Na_{86}(Al_{86}Si_{106}O_{384}).264H_2O$; Al/Si=0.811, and Zeolite Y: $Na_{56}(Al_{56}Si_{136}O_{384}).250H_2O$; Al/Si=0.412.

Containing the porous zeolite particles having an Al/Si ratio within the range of from 0.4 to 1.0 in the hydrophilic layer greatly raises the hydrophilicity of the hydrophilic layer itself, whereby contamination in the course of printing is inhibited and the water retention latitude is also increased. Further, contamination caused by a finger mark is also greatly reduced. When Al/Si is less than 0.4, the hydrophilicity is insufficient and the above-mentioned improving effects are lowered.

The hydrophilic matrix phase of the printing plate precursor of the invention can contain layer structural clay mineral particles as a metal oxide. Examples of the layer structural clay mineral particles include a clay mineral such as kaolinite, halloysite, talk, smectite such as montmorillonite, beidellite, hectorite and saponite, vermiculite, mica and chlorite; hydrotalcite; and a layer structural polysilicate such as kanemite, makatite, ilerite, magadiite and kenyte. Among them, ones having a higher electric charge density of the unit layer are higher in the polarity and in the hydrophilicity. Preferable charge density is not less than 0.25, more preferably not less than 0.6. Examples of the layer structural mineral particles having such a charge density include smectite having a negative charge density of from 0.25 to 0.6 and bermiculite having a negative charge density of from 0.6 to 0.9. Synthesized fluorinated mica is preferable since one having a stable quality, such as the particle size, is available. Among the synthesized fluorinated mica, swellable one is preferable and one freely swellable is more preferable.

An intercalation compound of the foregoing layer structural mineral particles such as a pillared crystal, or one treated by an ion exchange treatment or a surface treatment such as a silane coupling treatment or a complication treatment with an organic binder is also usable.

With respect to the size of the planar structural mineral particles, the particles have an average particle size (an average of the largest particle length) of preferably not more than 20 $\mu$m, and more preferably not more than 10 $\mu$m, and an average aspect ratio (the largest particle length/the particle thickness of preferably not less than 20, and more preferably not less than 50, in a state contained in the layer including the case that the particles are subjected to a swelling process and a dispersing layer-separation process. When the particle size is within the foregoing range, continuity to the parallel direction, which is a trait of the layer structural particle, and softness, are given to the coated layer so that a strong dry layer in which a crack is difficult to be formed can be obtained. The coating solution containing the layer structural clay mineral particles in a large amount can minimize particle sedimentation due to a viscosity increasing effect. The particle size greater than the foregoing may produce a non-uniform coated layer, resulting in poor layer strength. The aspect ratio lower than the foregoing reduces the planar particles, resulting in insufficient viscosity increase and reduction of particle sedimentation inhibiting effect.

The content of the layer structural clay mineral particles is preferably from 0.1 to 30% by weight, and more preferably from 1 to 10% by weight based on the total weight of the layer. Particularly, the addition of the swellable synthesized fluorinated mica or smectite is effective if the adding amount is small. The layer structural clay mineral particles may be added in the form of powder to a coating liquid, but it is preferred that gel of the particles which is obtained by being swelled in water, is added to the coating liquid in order to obtain a good dispersity according to an easy coating liquid preparation method which requires no dispersion process comprising dispersion due to media.

An aqueous solution of a silicate is also usable as another additive to the hydrophilic matrix phase in the invention. An alkali metal silicate such as sodium silicate, potassium silicate or lithium silicate is preferable, and the $SiO_2/M_2O$ is preferably selected so that the pH value of the coating liquid after addition of the silicate exceeds 13 in order to prevent dissolution of the porous metal oxide particles or the colloidal silica particles.

An inorganic polymer or an inorganic-organic hybrid polymer prepared by a sol-gel method employing a metal alkoxide. Known methods described in S. Sakka "Application of Sol-Gel Method" or in the publications cited in the above publication can be applied to prepare the inorganic polymer or the inorganic-organic hybridpolymer by the sol-gel method.

In the invention, the hydrophilic matrix phase preferably contains a water soluble resin. Examples of the water soluble resin include polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylamide, and polyvinyl pyrrolidone. In the invention, polysaccharides are preferably used as the water soluble resin.

As the polysaccharide, starches, celluloses, polyuronic acid and pullulan can be used. Among them, a cellulose derivative such as a methyl cellulose salt, a carboxymethyl cellulose salt or a hydroxyethyl cellulose salt is preferable, and a sodium or ammonium salt of carboxymethyl cellulose is more preferable. These polysaccharides can form a preferred surface shape of the hydrophilic layer.

The surface of the hydrophilic layer preferably has a convexoconcave structure having a pitch of from 0.1 to 50 $\mu$m such as the grained aluminum surface of an aluminum PS plate. The water retention ability and the image maintaining ability are raised by such a convexoconcave structure of the surface. Such a convexoconcave structure can also be formed by adding in an appropriate amount a filler having a suitable particle size to the coating liquid of the hydrophilic layer. However, the convexoconcave structure is preferably formed by coating a coating liquid for the hydrophilic layer containing the alkaline colloidal silica and the water-soluble polysaccharide so that the phase separation occurs at the time of drying the coated liquid, whereby a structure is obtained which provides a good printing performance.

The shape of the convexoconcave structure such as the pitch and the surface roughness thereof can be suitably controlled by the kinds and the adding amount of the alkaline colloidal silica particles, the kinds and the adding amount of the water-soluble polysaccharide, the kinds and the adding amount of another additive, a solid concentration of the coating liquid, a wet layer thickness or a drying condition.

In the invention, it is preferred that the water soluble resin contained in the hydrophilic matrix phase is water soluble, and at least a part of the resin exists in the hydrophilic layer in a state capable of being dissolved in water. If a water soluble carbon atom-containing material is cross-linked by a crosslinking agent and is insoluble in water, its hydrophilicity is lowered, resulting in problem of lowering printing performance. A cationic resin may also be contained in the hydrophilic layer. Examples of the cationic resin include a polyalkylene-polyamine such as a polyethyleneamine or polypropylenepolyamine or its derivative, an acryl resin having a tertiary amino group or a quaternary ammonium group and diacrylamine. The cationic resin may be added in a form of fine particles. Examples of such particles include the cationic microgel described in Japanese Patent O.P.I. Publication No. 6-161101.

A water-soluble surfactant may be added for improving the coating ability of the coating liquid for the hydrophilic layer in the invention. A silicon atom-containing surfactant and a fluorine atom-containing surfactant are preferably used. The silicon atom-containing surfactant is especially preferred in that it minimizes printing contamination. The content of the surfactant is preferably from 0.01 to 3% by weight, and more preferably from 0.03 to 1% by weight based on the total weight of the hydrophilic layer (or the solid content of the coating liquid).

The hydrophilic layer in the invention can contain a phosphate. Since a coating liquid for the hydrophilic layer is preferably alkaline, the phosphate to be added to the hydrophilic layer is preferably sodium phosphate or sodium monohydrogen phosphate. The addition of the phosphate provides improved reproduction of dots at shadow portions. The content of the phosphate is preferably from 0.1 to 5% by weight, and more preferably from 0.5 to 2% by weight in terms of amount excluding hydrated water.

The hydrophilic layer in the invention can contain a light heat conversion material as described later in order to carry out light heat conversion. When the material is in the particle form, the particle size is preferably less than 1 μm.

Inorganic Particles or Inorganic Material Coated Particles Both Having a Particle Size Not Less than 1 μm Examples of the inorganic particles include well-known metal oxide particles include particles of silica, alumina, titania and zirconia. Porous metal oxide particles are preferably used in order to prevent sedimentation of the particles in a coating liquid. Examples of the porous metal oxide particles include the porous silica particles and the porous aluminosilicate particles described above.

The inorganic material coated particles include particles in which organic particles such as polymethyl methacrylate particles or polystyrene particles form cores and the cores are covered with inorganic particles having a size smaller than that of the cores. The particle size of the inorganic particles is preferably from 1/10 to 1/100 of that of the cores. Further, well-known metal oxide particles include particles of silica, alumina, titania and zirconia can be used as the inorganic particles. There are various covering methods, but a dry covering method is preferred in which the cores collide with the covering materials at high speed in air as in a hybridizer for the covering materials to penetrate the surface of the cores and fix them there.

Particles in which organic particles are plated with a metal can be used. Examples of such particles include Micropearl AU produced by Sekisui Kagaku Co., Ltd., in which resin particles are plated with a metal.

The inorganic particles or inorganic material coated particles have a particle size of not less than 1 μm, preferably from 1 to 10 μm, still more preferably from 1.5 to 8 μm, and most preferably from 2 to 6 μm.

When the particle size exceeds 10 μm, it may lower dissolution of formed images or result in contamination of blanket during printing. In the invention, the content of the particles having a particle size of not less than 1 μm in the hydrophilic layer is suitably adjusted to satisfy the parameters regarding the invention, but is preferably from 1 to 50% by weight, and more preferably from 5 to 40% by weight, based on the hydrophilic layer. The content of materials containing a carbon atom such as the organic resins or carbon black in the hydrophilic layer is preferably lower in increasing hydrophilicity of the hydrophilic layer. The total content of these materials in the hydrophilic layer is preferably less than 9% by weight, and more preferably less than 5% by weight.

(Light Heat Conversion Material)

In the invention, the hydrophilic layer or ink repellent layer, an under layer, a back coat layer, a layer formed on the surface of a plate cylinder or another layer can have a light heat conversion capability and preferably contains a light heat conversion material.

Examples of the light heat conversion material include the following substances:

Examples of the light-heat conversion material include a general infrared absorbing dye such as a cyanine dye, a chloconium dye, a polymethine dye, an azulenium dye, a squalenium dye, a thiopyrylium dye, a naphthoquinone dye or an anthraquinone dye, and an organometallic complex such as a phthalocyanine compound, a naphthalocyanine compound, an azo compound, a thioamide compound, a dithiol compound or an indoaniline compound. Exemplarily, the light-heat conversion materials include compounds disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds may be used singly or in combination.

Examples of pigment include carbon, graphite, a metal and a metal oxide. Furnace black and acetylene black is preferably used as the carbon. The graininess ($d_{50}$) thereof is preferably not more than 100 nm, and more preferably not more than 50 nm.

The graphite is one having a particle size of preferably not more than 0.5 μm, more preferably not more than 100 nm, and most preferably not more than 50 nm.

As the metal, any metal can be used as long as the metal is in a form of fine particles having preferably a particle size of not more than 0.5 μm, more preferably not more than 100 nm, and most preferably not more than 50 nm. The metal may have any shape such as spherical, flaky and needle-like. Colloidal metal particles such as those of silver or gold are particularly preferred.

As the metal oxide, materials having black color in the visible regions or materials which are electro-conductive or semi-conductive can be used. Examples of the former include black iron oxide ($Fe_3O_4$), and black complex metal oxides containing at least two metals. Examples of the latter include Sb-doped $SnO_2$ (ATO), Sn-added $In_2O_3$ (ITO), $TiO_2$, TiO prepared by reducing $TiO_2$ (titanium oxide nitride, generally titanium black). Particles prepared by covering a core material such as $BaSO_4$, $TiO_2$, $9Al_2O_3.2B_2O$ and $K_2O.nTiO_2$ with these metal oxides is usable. The particle size of these particles is preferably not more than 0.5 μm, more preferably not more than 100 nm, and most preferably not more than 50 nm.

Materials containing a carbon atom of light heat conversion materials can be incorporated in the hydrophilic layer in an amount of less than 9% by weight, and preferably less than 5% by weight based on the weight of the hydrophilic layer.

As the light heat conversion material, complex metal oxides containing at least two metals are especially preferred.

Typically, the black complex metal oxides include complex metal oxides comprising at least two selected from Al, Ti, Cr, Mn, Fe, Co, Ni, Cu, Zn, Sb, and Ba. These can be prepared according to the methods disclosed in Japanese Patent O.P.I. Publication Nos. 9-27393, 9-25126, 9-237570, 9-241529 and 10-231441.

The complex metal oxide used in the invention is preferably a complex Cu—Cr—Mn type metal oxide or a Cu—Fe—Mn type metal oxide. The Cu—Cr—Mn type metal oxides are preferably subjected to the treatment disclosed in Japanese Patent O.P.I. Publication Nos. 8-27393 in order to reduce isolation of a 6-valent chromium ion. These complex metal oxides have a high color density and a high light heat conversion efficiency as compared with another metal oxide.

The primary average particle size of these complex metal oxides is preferably from 0.001 to 1.0 μm, and more preferably from 0.01 to 0.5 μm. The primary average particle size of from 0.001 to 1.0 μm improves a light heat conversion efficiency relative to the addition amount of the particles, and the primary average particle size of from 0.05 to 0.5 μm further improves a light heat conversion efficiency relative to the addition amount of the particles. The light heat conversion efficiency relative to the addition amount of the particles depends on a dispersity of the particles, and the well-dispersed particles have a high light heat conversion efficiency. Accordingly, these complex metal oxide particles are preferably dispersed according to a known dispersing method, separately to a dispersion liquid (paste), before being added to a coating liquid for the particle containing layer. The metal oxides having a primary average particle size of less than 0.001 are not preferred since they are difficult to disperse. A dispersant is optionally used for dispersion. The addition amount of the dispersant is preferably from 0.01 to 5% by weight, and more preferably from 0.1 to 2% by weight, based on the weight of the complex metal oxide particles. Kinds of the dispersant are not specifically limited, but the dispersant is preferably a silicon-containing surfactant.

The addition amount of the complex metal oxide is preferably 0.1 to 50% by weight, more preferably 1 to 30% by weight, and most preferably 3 to 25% by weight based on the weight of hydrophilic layer.

(Under Layer)

In the invention, when an under layer is provided under the hydrophilic layer or an ink repellent layer as described later, materials used in the under layer include the same materials as in the hydrophilic layer described previously. The under layer, which is porous, is less advantageous. The under layer is preferably non-porous. The porosity providing agent content of the under layer is preferably lower than that of the hydrophilic layer in view of strength of the under layer. It is more preferable that the under layer contains no porosity providing agent.

In order to control the surface form of the under layer, the under layer can also contain inorganic particles or inorganic compound coated particles each having a particle size of not less than 1 μm. The content of the particles having a particle size of not less than 1 μm in the under layer is preferably from 1 to 50% by weight, and more preferably from 5 to 40% by weight, based on the under layer.

Like the hydrophilic layer, the content of materials containing a carbon atom such as the organic resins or carbon black in the under layer is preferably lower in increasing hydrophilicity of the under layer. The total content of these materials in the under layer is preferably less than 9% by weight, and more preferably less than 5% by weight.

(Image Formation Layer)

In the planographic printing plate precursor of the invention, an image formation layer containing heat melting particles and/or heat fusible particles or other materials described below can be provided on the hydrophilic layer described above.

(Heat Melting Particles)

The heat melting particles used in the invention are particularly particles having a low melt viscosity, or particles formed from materials generally classified into wax. The materials preferably have a softening point of from 40° C. to 120° C. and a melting point of from 60° C. to 150° C., and more preferably a softening point of from 40° C. to 100° C. and a melting point of from 60° C. to 120° C. The melting point less than 60° C. has a problem in storage stability and the melting point exceeding 300° C. lowers ink receptive sensitivity.

Materials usable include paraffin, polyolefin, polyethylene wax, microcrystalline wax, and fatty acid wax. The molecular weight thereof is approximately from 800 to 10,000. A polar group such as a hydroxyl group, an ester group, a carboxyl group, an aldehyde group and a peroxide group may be introduced into the wax by oxidation to increase the emulsification ability. Moreover, stearoamide, linolenamide, laurylamide, myristylamide, hardened cattle fatty acid amide, parmitylamide, oleylamide, rice bran oil fatty acid amide, palm oil fatty acid amide, a methylol compound of the above-mentioned amide compounds, methylenebissteastearoamide and ethylenebissteastearoamide may be added to the wax to lower the softening point or to raise the working efficiency. A cumarone-indene resin, a rosin-modified phenol resin, a terpene-modified phenol resin, a xylene resin, a ketone resin, an acryl resin, an ionomer and a copolymer of these resins may also be usable.

Among them, polyethylene, microcrystalline wax, fatty acid ester and fatty acid are preferably contained. A high sensitive image formation can be performed since these materials each have a relative low melting point and a low melt viscosity. These materials each have a lubrication ability. Accordingly, even when a shearing force is applied to the surface layer of the printing plate precursor, the layer damage is minimized, and resistance to contaminations which may be caused by scratch is further enhanced.

The heat melting particles are preferably dispersible in water. The average particle size thereof is preferably from 0.01 to 10 μm, and more preferably from 0.1 to 3 μm. When a layer containing the heat melting particles is coated on the porous hydrophilic layer, the particles having an average particle size less than 0.01 μm may enter the pores of the hydrophilic layer or the valleys between the neighboring two peaks on the hydrophilic layer surface, resulting in insufficient on press development and background contaminations. The particles having an average particle size exceeding 10 μm may result in lowering of dissolving power.

The composition of the heat melting particles may be continuously varied from the interior to the surface of the particles. The particles may be covered with a different material. Known microcapsule production method or sol-gel method can be applied for covering the particles. The heat melting particle content of the layer is preferably 1 to 90% by weight, and more preferably 5 to 80% by weight based on the total layer weight.

(Heat Fusible Particles)

The heat fusible particles in the invention include thermoplastic hydrophobic polymer particles. Although there is no specific limitation to the upper limit of the softening point of the thermoplastic hydrophobic polymer particles, the softening point is preferably lower than the decomposition temperature of the polymer particles. The weight average molecular weight (Mw) of the polymer is preferably within the range of from 10,000 to 1,000,000.

Examples of the polymer consisting the polymer particles include a diene (co)polymer such as polypropylene, polybutadiene, polyisoprene or an ethylene-butadiene copolymer; a synthetic rubber such as a styrene-butadiene copolymer, a methyl methacrylate-butadiene copolymer or an acrylonitrile-butadiene copolymer; a (meth)acrylate (co) polymer or a (meth)acrylic acid (co)polymer such as polymethyl methacrylate, a methyl methacrylate-(2-ethylhexyl) acrylate copolymer, a methyl methacrylate-methacrylic acid copolymer, or a methyl acrylate-(N-methylolacrylamide); polyacrylonitrile; a vinyl ester (co)polymer such as a polyvinyl acetate, a vinyl acetate-vinyl propionate copolymer and a vinyl acetate-ethylene copolymer, or a vinyl acetate-2-hexylethyl acrylate copolymer; and polyvinyl chloride, polyvinylidene chloride, polystyrene and a copolymer thereof. Among them, the (meth)acrylate polymer, the (meth)acrylic acid (co)polymer, the vinyl ester (co)polymer, the polystyrene and the synthetic rubbers are preferably used.

The polymer particles may be prepared from a polymer synthesized by any known method such as an emulsion polymerization method, a suspension polymerization method, a solution polymerization method and a gas phase polymerization method. The particles of the polymer synthesized by the solution polymerization method or the gas phase polymerization method can be produced by a method in which an organic solution of the polymer is sprayed into an inactive gas and dried, and a method in which the polymer is dissolved in a water-immiscible solvent, then the resulting solution is dispersed in water or an aqueous medium and the solvent is removed by distillation. In both of the methods, a surfactant such as sodium lauryl sulfate, sodium dodecylbenzenesulfate or polyethylene glycol, or a water-soluble resin such as poly(vinyl alcohol) may be optionally used as a dispersing agent or stabilizing agent.

The heat fusible particles are preferably dispersible in water. The average particle size of the heat fusible particles is preferably from 0.01 to 10 $\mu$m, and more preferably from 0.1 to 3 $\mu$m. When a layer containing the heat fusible particles having an average particle size less than 0.01 $\mu$m is coated on the porous hydrophilic layer, the particles may enter the pores of the hydrophilic layer or the valleys between the neighboring two peaks on the hydrophilic layer surface, resulting in insufficient on press development and background contaminations. The heat fusible particles having an average particle size exceeding 10 $\mu$m may result in lowering of dissolving power. Accordingly, the particle size range falling within the aforementioned is preferred.

Further, the composition of the heat fusible particles may be continuously varied from the interior to the surface of the particles. The particles may be covered with a different material. As a covering method, known methods such as a microcapsule method and a sol-gel method are usable. The heat fusible particle content of the layer is preferably from 1 to 90% by weight, and more preferably from 5 to 80% by weight based on the total weight of the layer. The image formation layer preferably contains the light heat conversion materials described above.

(Water Soluble Material)

In the invention, the image formation layer can further contain a water soluble material. When the image formation layer at unexposed portions is removed on a press with dampening water or ink, the water soluble material makes it possible to easily remove the layer.

Regarding the water soluble material, those described above as water soluble materials to be contained in the hydrophilic layer can be used. The image formation layer in the invention preferably contains saccharides, and more preferably contains oligosaccharides. Since the oligosaccharides are easily dissolved in water, removal on a press of unexposed portions of an oligosaccharide-containing layer can be easily carried out dissolving the saccharide in water. The removal does not require a specific system, and can be carried out conducting the same manner as in the beginning of printing of a conventional PS plate, which does not increase loss of prints at the beginning of printing. Use of the oligosaccharide does not lower hydrophilicity of the hydrophilic layer and can maintain good printing performance of the hydrophilic layer. The oligosaccharide is a water-soluble crystalline substance generally having a sweet taste, which is formed by a dehydration condensation reaction of plural monosaccharide molecules. The oligosaccharide is one kind of o-glycoside having a saccharide as the aglycon. The oligosaccharide is easily hydrolyzed by an acid to form a monosaccharide, and is classified according to the number of monosaccharide molecules of the resulting hydrolysis compounds, for example, into disaccharide, trisaccharide, tetrasaccharide, and pentasscharide. The oligosaccharide referred to in the invention means di- to deca-saccharides.

The oligosaccharide is classified into a reducing oligosaccharide and a non-reducing oligosaccharide according to presence or absence of a reducing group in the molecule. The oligosaccharide is also classified into a homo-oligosaccharide composed of the same kind of monosaccharide and a hetero-oligosaccharide composed of two or more kinds of monosaccharides. The oligosaccharide naturally exists in a free state or a glycoside state. Moreover, various oligosaccharides are formed by glycosyl transition by action of an enzyme.

The oligosaccharide frequently exists in a hydrated state in an ordinary atmosphere. The melting points of the hydrated one and anhydrous one are different from each other as shown in the following Table 1.

TABLE 1

| Kinds of oligosaccharide | | Melting point (° C.) Hydrates | Anhydrides |
|---|---|---|---|
| Raffinose | Trisaccharide | 80 (Pentahydrate) | 118 |
| Trehalose | Disaccharide | 97 (Dihydrate) | 215 |
| Maltose | Disaccharide | 103 (Monohydrate) | 108 |
| Galactose | Disaccharide | 119 (Monohydrate) | 167 |
| Sucrose | Disaccharide | None | 182 |
| Lactose | Disaccharide | 201 (Monohydrate) | 252 |

In the invention, the layer containing a saccharide is preferably formed coating an aqueous coating solution containing the saccharide on a support. When an oligossccharide in the layer formed from the aqueous coating solution is one capable of forming a hydrate, the melting point of the oligosaccharide is that of its hydrate. Since the oligosaccharides, having a relatively low melting point, also melt within the temperature range at which heat melting particles melt or heat fusible particles fuse, they do not cause image formation inhibition resulting from permeation of the heat melting particles into the porous hydrophilic layer and/or fusion adhesion of the heat fusible particles to the hydrophilic layer.

Among the oligosaccharides, trehalose with comparatively high purity is available on the market, and has an extremely low hygroscopicity, although it has high water solubility, providing excellent storage stability and excellent development property on a printing press.

When oligosaccharide hydrates are heat melted to remove the hydrate water and solidified, the oligosaccharide is in a form of anhydride for a short period after solidification. Trehalose is characterized in that a melting point of trehalose anhydride is not less than 100° C. higher that that of trehalose hydrate. This characteristics provides a high melting point and reduced heat fusibility at exposed portions of the trehalose-containing layer immediately after heat-fused by infrared ray exposure and re-solidified, preventing image defects at exposure such as banding from occurring. In order to attain the object of the invention, trehalose is preferable among oligosaccharides. The oligosaccharide content of the layer is preferably from 1 to 90% by weight, and more preferably from 10 to 80% by weight, based on the total weight of the layer.

(Ink Repellent Layer)

The ink repellent layer in the invention is, for example, a silicon rubber layer used in the ink repellent layer of a known waterless planographic printing plate.

The silicone rubber layer usable in the invention may be optionally selected from known ones such as those disclosed in JP O.P.I. No. 7-164773. A condensation cross-linking type silicone rubber by which the silicone rubber layer composition is hardened by a condensation reaction, and an addition cross-linking type silicone rubber by which the silicone rubber layer composition is hardened by an addition reaction, are preferably used.

The condensation cross-linking type silicone rubber layer contains, as essential components, a linear organopolysiloxane having a hydroxyl group at each of the both terminals and a reactive silane compound capable of forming a silicone rubber layer by cross-linking with the linear organopolysiloxane.

The condensation cross-linking type silicone rubber layer to be used in the invention is hardened by the condensation reaction in the presence of an optional condensation catalyst such as an organic carboxylic acid, a titanate ester, a stannous ester, an aluminum organic ester and a platinum catalyst for raising the reaction efficiency of the reactive silane compound with the linear organopolysiloxane having a hydroxyl group at each of the both terminals.

In the invention, the ratio of the linear organopolysiloxane having a hydroxyl group at each of the both terminals, the reactive silane compound and the condensation catalyst in the silicone rubber layer is 80 to 98%, preferably from 85 to 98%, by weight of the linear organopolysiloxane having a hydroxyl group at each of the both terminals, usually from 2 to 20%, preferably from 2 to 15%, more preferably from 2 to 7%, by weight of the reactive silane compound and from 0.05 to 5%, preferably from 0.1 to 3, more preferably from 0.1 to 1%, by weight.

In the silicone rubber layer to be used in the invention, a polysiloxane compound other than the linear organopolysiloxane having a hydroxyl group at each of the both terminals may be added in a ratio of from 2 to 15%, preferably 3 to 12%, by weight of the whole weight of the solid components of the silicone rubber layer to raise the ink-repelling ability of the silicone rubber layer. Example of such the siloxane compound includes a polydimethylsiloxane having a trimethylsilyl group at each of the both terminals and a Mw of from 10,000 to 1,000,000.

The addition cross-linking type silicone rubber layer contains, as the essential components, an organopolysiloxane compound having at least two aliphatic unsaturated groups in the molecular thereof and an organopolysiloxane compound having at least two Si—H bonds in the molecular thereof which is cross-linked with the organopolysiloxane compound having at least two aliphatic unsaturated groups in the molecular thereof to form the silicone rubber layer.

The organopolysiloxane compound having at least two aliphatic unsaturated groups in the molecular thereof may have any structure of linear, cyclic or branched, and ones having the linear structure are preferred. Examples of the aliphatic unsaturated group include an alkenyl group such as a vinyl group, an aryl group, a butenyl group, a pentenyl group, a hexenyl group; a cycloalkenyl group such as a cyclopentenyl group, a cyclohexenyl group, a cycloheptenyl group and a cyclooctenyl group,; and an alkynyl group such as an ethynyl group, a propynyl group, a butynyl group, a pentynyl group and a hexynyl group. Among them, an alkenyl group having an unsaturated bond at the terminal is preferable from the viewpoint of the reactivity, and a vinyl group is particularly preferable. The substituent other than the aliphatic unsaturated group is preferably a methyl group for obtaining a high ink-repelling ability.

Mw of the organopolysiloxane having at least two aliphatic unsaturated groups in the molecule thereof is usually from 500 to 500,000, preferably from 1,000 to 3,000,000. When Mw is too low, the strength of the silicone rubber layer is lowered and the silicone rubber layer tends to be damaged at the time of printing. As a result of that, the ink repelling ability of the silicone rubber layer is degraded at the damaged portion and the ink is easily adhered to such the portion, and the contamination on the printed image is caused. When the Mw is too high, lowering in the sensitivity and in the image reproducibility tends to be occurred since the removing the silicone layer by ablation becomes insufficient.

The organopolysiloxane compound having at least two Si—H bonds in the molecular thereof may have any structure of linear, cyclic or branched, and ones having the linear structure is preferred. The Si—H bond may be existed at either the terminal or intermediate portion of the siloxane skeleton, and the ratio of the hydrogen atom to the total number of the substituent is usually from 1 to 60%, preferably from 2 to 50%. The substituent other than the hydrogen atom is preferably a methyl group for obtaining a high ink-repelling ability. The Mw of the organopolysiloxane compound having at least two Si—H bonds in the molecular thereof is usually from 300 to 300,000, preferably from 500 to 200,000. The Mw too high tends to cause lowering in the sensitivity and in the image reproducibility.

A addition reaction catalyst is usually used to occur the addition reaction of the organopolysiloxane compound having at least two aliphatic unsaturated groups in the molecular thereof with the organopolysiloxane compound having at least two Si—H bonds in the molecular thereof. The addition reaction catalyst can be optionally selected from known ones, and a platinum catalyst is preferably used. One or a mixture selected from metals of platinum group and compounds of metal of platinum group may be preferably used as the addition reaction catalyst. Examples of the metal of platinum group include elemental platinum such as platinum black, elemental palladium such as palladium black and elemental rhodium. Examples of the compound of metal of platinum group include chloroplatinic acid, a platino-olefin complex, a platino-alcohol complex, a platino-ketone complex, a complex of platinum and vinylsiloxane, platinum tetrakis(triphenyl-phosphine) and palladium tetrakis (triphenylphosphine). Among them, chloroplatinic acid or platino-olefin complex dissolved in an alcoholic solvent, an ether solvent or a carbon hydride solvent is particularly preferred.

The ratio of the components for forming the above-mentioned silicone rubber layer is 80 to 98%, preferably from 85 to 98%, by weight of the organopolysiloxane having at least two aliphatic unsaturated groups, usually from 2 to 20%, preferably from 2 to 15%, by weight of the organosiloxane having at least two Si—H bonds in the molecular thereof and from 0.0001 to 10%, preferably from 0.0001 to 5%, by weight of the addition reaction catalyst.

When the content of the organo-siloxane having at least two Si—H bonds in the molecular thereof is too low, the strength of the silicone rubber layer is lowered and the ink-repelling ability and the printing durability are degraded. When the content of that is too high, the sensitivity and the image reproducibility are lowered. An amino containing organic silicon compound having a hydrolyzable group represented by formula (VII) disclosed in Japanese Patent O.P.I. Publication Nos. 10-244773 may be added to the addition cross-linking type silicone rubber layer used in the invention for raising the strength of the layer.

The ratio of the amino-containing organic silicon compound to the whole solid components weight of the silicone rubber layer is from 0 to 10%, preferably from 0 to 5%, by weight. A hardening delaying agent may be added into the addition cross-linking silicone rubber layer to inhibit the suddenly hardening of the silicone composition at the time of coating the silicone rubber layer. The hardening delaying agent can be optionally selected from compounds known as the hardening delaying agent such as an acetylene alcohol, a maleic ester, a silylated compound of acetylene alcohol, a silylated compound of maleic acid, a triacyl isocyanulate and a vinylsiloxane.

The adding amount of the hardening delaying agent is usually from 0.0001 to 1.0 parts by weight of the whole solid components of the silicone rubber layer, even though the amount may be different according to the desired hardening speed. Inorganic filler such as silica, titanium oxide and aluminum oxide may be added into the above-mentioned condensation cross-linking type and addition cross-linking type-silicone rubber layer to raise the strength thereof. Silica is particularly preferred. The filler having a diameter of not more than 500 $\mu$m is preferable from the view point of the dispersibility and the stability of dispersion.

The scratch resistivity of the silicone rubber layer is preferably within the range of from 10 to 100 g. The scratch resistivity is expressed by the load in gram necessary to form a scratch when the layer is moved with a speed of 10 cm/minute while a load is applied through a needle of 0.2 mm touched on the surface of the layer. Suitable printing properties such as the printing ink-repelling ability, the printing durability, the sensitivity and the image reproducibility can be obtained when the scratch resistivity of the layer is within such the range. The thickness of the silicone rubber layer usable in the invention is usually from 0.1 to 10 $\mu$m, preferably from 0.2 to 5 $\mu$m, more preferably from 0.3 to 2 $\mu$m.

The silicone rubber layer each can be formed by dissolving the silicone rubber layer composition in a suitable solvent, coating thus obtained coating solution on the substrate by a coating device such as a wire bar, a spinner or a roller coater, and drying thus coated layer. Examples of the solvent for the coating solution include n-hexane, cyclohexane, petroleum ether, and aliphatic carbon hydride solvents Isopar E, H and G, manufactured by Exxon Co., Ltd., and a mixture of the foregoing solvents with a ketone such as methyl ethyl ketone and cyclohexanone, an ester such as butyl acetate, amyl acetate and ethyl propionate, a carbon hydride or a halogenated carbon hydride such as toluene, xylene, monochlorobenzene, carbon tetrachloride, trichloroethylene and trichloroethane, an ether such as methyl cellosolve, ethyl cellosolve and tetrahydrofuran, and polypropylene glycol monomethyl ether acetate, pentoxon or dimethylformamide.

An adhesion layer may be provided between the light-heat conversion layer and the silicone rubber layer for raising the adhesiveness of the silicone rubber layer to the light-heat conversion layer. For the adhesion layer, one optionally selected from the organic high molecular weight substance described in the description of the light-heat conversion layer and the silicone rubber described in the description of the silicone rubber layer can be used, and a combination of an urethane type organic high molecular weight substance or a condensation type reactive silane compound such as a multi-functional alkoxysilane and a multi-functional acetoxysilane, and a polydimethylsiloxane having a reactive group at the both terminals or in the main chain are preferably used. Concrete examples include Vyron 300, Vyron UR8200, each manufactured by Toyo Boseki Co., Ltd., Primer A, Primer B, Primer C, Primer D, Primer D2 and Primer E, each manufactured by Toray Silicone Co., Ltd., a combination of Takenate A367H and Takenate A-7, a combination of Takenate A-9690 and Takenate A-5, and a combination of Takenate A-968 and Takenate A-8, each manufactured by Takeda Yakuhin Co., Ltd. These adhesion layers is usually coated and dried so that the dry thickness of the layer is within the range of from 0.05 to 10 $\mu$m.

The planographic printing plate precursor having an ink repellent layer comprises as a fundamental structure, a substrate and provided thereon, a light heat conversion layer and an ink repellent layer in that order. The invention is not specifically limited. Herein, the above structure will be explained.

When the planographic printing plate precursor is exposed to be heated, the light heat conversion layer is ablated or adhesion between the light heat conversion layer and ink repellent layer (silicon rubber layer) is weakened whereby the silicon rubber layer at exposed portions is likely to be separated (cracks in a part of the layer may occur or a part of the layer may scatter), and the layer at exposed portions can be removed with a relatively weak force. Herein, image portions are formed at exposed portions employing an ink receptive light heat conversion layer or an ink receptive substrate.

The silicon rubber layer at exposed portions can be removed by being wiped off with cloth impregnated with an appropriate removing solution or by being scrubbed in an appropriate removing solution. The silicon rubber layer at exposed portions can be also removed by repeating contact and separation of rollers of the printing press on the plate cylinder at an initial stage of printing.

(Image Formation and Printing)

In the invention, image formation on the printing plate precursor or fixation on a plate cylinder of the printing plate precursor can be carried out by applying heat, and is carried out preferably by infrared to near-infrared ray exposure.

Exposure applied in the invention is preferably scanning exposure, which is carried out employing a laser which can emit light having a wavelength of infrared and/or near-infrared regions, that is, a wavelength of from 700 to 1500 nm. As the laser, a gas laser can be used, but a semi-conductor laser, which emits light having a near-infrared region wavelength, is preferably used.

A device suitable for the scanning exposure in the invention may be any device capable of forming an image on the printing plate precursor according to image signals from a computer employing a semi-conductor laser.

Generally, the following scanning exposure processes are mentioned.

(1) A process in which a plate precursor provided on a fixed horizontal plate is scanning exposed in two dimensions, employing one or several laser beams.

(2) A process in which the surface of a plate precursor provided along the inner peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

(3) A process in which the surface of a plate precursor provided along the outer peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

In the invention, the process (3) above is preferable, and especially preferable when a printing plate precursor mounted on a plate cylinder of a printing press is scanning exposed.

In the invention, an image can be formed by imagewise providing a lipophilic material directly on the surface of the printing plate precursor.

As one of the methods of imagewise providing the lipophilic material, there is a method of employing a known thermal transfer process. For example, there is a method of imagewise transferring a heat fusible ink of an ink ribbon having a heat fusible ink layer onto the surface of the hydrophilic layer employing a thermal head.

There is also a method of mounting the printing plate precursor on an exposure drum of a digital proof apparatus employing an infrared laser heat fusion transfer process, with the hydrophilic layer outwardly, further providing an ink sheet having an ink layer on the hydrophilic layer so that the ink layer contacts the hydrophilic layer, and then imagewise exposing the ink sheet by infrared laser to imagewise transfer a heat fusible ink of the ink layer onto the surface of the hydrophilic layer. In this case, a light heat conversion material may be contained in the hydrophilic layer of the printing plate precursor, in the ink sheet, or in both hydrophilic layer and ink sheet.

An image, which has been formed on the hydrophilic layer of the printing plate precursor employing a heat fusible ink, can be more firmly adhered to the hydrophilic layer by heating the printing plate precursor. When the hydrophilic layer contains a light heat conversion material, the heating can be carried out employing an infrared laser exposure or a flush exposure such as a xenon lamp exposure.

As another method of imagewise providing the lipophilic material, there is a method of employing a known ink jet process. In this case, inks used include a lipophilic ink disclosed in Japanese Patent Publication No. 2995075, a hot melt ink disclosed in Japanese Patent O.P.I. Publication No. 10-24550, a lipophilic ink, in which hydrophobic resin particles being a solid at ordinary temperature are dispersed, disclosed in Japanese Patent O.P.I. Publication No. 10-157053, and an aqueous ink, in which hydrophobic thermoplastic resin particles being a solid at ordinary temperature are dispersed. In the invention, a radiation curable ink is preferably used.

The radiation curable ink in the invention contains at least a polymerizable compound, and can contain a colorant to produce a visible image.

As the colorant, a colorant such as a dye or pigment, which is soluble or dispersible in a main polymerizable compound, can be used. When pigment is used, dispersion treatment is carried out, since its degree of dispersion has a great influence on a color density. Devices for dispersing pigment include a ball mill, an atriter, a roll mill, an agitator, a Henschel mixer, a colloid mill, a supersonic homogenizer, a pearl mill, a wet jet mill, and a paint shaker. When pigment is dispersed, a dispersant can be added. As the dispersant, a polymer dispersant is preferably used, and preferred examples of the polymer dispersant include Solsperse series produced by Zeneca Co., Ltd. As an auxiliary dispersant, a synergist according to kinds of dispersant can be used. An addition amount of the dispersant or auxiliary dispersant is preferably from 1 to 50 parts by weight based on 100 parts by weight of pigment used. A dispersion medium is a solvent or a polymerizable compound. It is preferred that the radiation curable ink used in the invention does not contain a solvent, since it is hardened immediately after jetted to an image recording medium. The residual solvent in the hardened image results in lowering of solvent resistance and problem of VOC. The dispersion medium is preferably a polymerizable compound, and more preferably a monomer having the lowest viscosity among monomers.

Pigment, a dispersant, a dispersion medium, dispersing conditions and a filtration condition are preferably determined to obtain pigment particles with an average particle size of preferably from 0.08 to 0.3 $\mu$m, a maximum particle size of from 0.3 to 10 $\mu$m, and preferably from 0.3 to 3 $\mu$m. The above range of the particle size can prevent clogging of an ink head nozzle, and provide excellent ink storage stability, ink transparency and ink curing sensitivity. The colorant content of ink is preferably from 0.1 to 10% by weight.

The colorant content of ink is preferably from 0.1 to 10% by weight.

As radiation polymerizable compounds, there are known radical polymerizable compounds such as photo-curable compounds used in the photopolymerizable composition disclosed in Japanese Patent O.P.I. Publication Nos. 7-159983, 8-224982, and 10-863 and Japanese Patent Publication No. 7-31399, or cation polymerization photo-curable compounds. Recently, cation polymerization photo-curable resins sensitive to light having a wavelength identical to or longer than that of visible light are disclosed in Japanese Patent O.P.I. Publication Nos. 6-43633 and 8-324137.

The radical polymerizable compound is an ethylenically unsaturated compound capable of being polymerized by a radical, and is any compound, as long as it has at least one ethylenically unsaturated double bond in the molecule. The radical polymerizable compound may have any structure in the form of monomer, oligomer or polymer. The radical polymerizable compound can be used singly or in combination of two or more kinds in any content ratio, according to the objects of the usage. A polyfunctional compound having at least two functional groups is preferable to a monofunctional compound. Use of two kinds or more of the polyfunctional compound is more preferable in controlling physical properties or performance of ink.

The ethylenically unsaturated compound, which is capable of being polymerized by a radical, includes an unsaturated carboxylic acid such as acrylic acid, methacrylic acid, itaconic acid, crotonic acid, isocrotonic acid, or maleic acid or its salt, ester, urethane, amide or anhydride; acrylonitrile; styrene; unsaturated polyesters; unsaturated polyethers; unsaturated polyamides; and unsaturated polyurethanes. The examples include an acrylic acid-derivative such as 2-ethylhexyl acrylate, 2-hydroxyethyl acrylate, butoxyethyl acrylate, carbitol acrylate, cyclohexyl acrylate, tetrahydrofurfuryl acrylate, benzyl acrylate, bis(4-acryloxypolyethoxyphenyl)propane, neopentyl glycol diacrylate, 1,6-hexanediol diacrylate, ethylene glycol diacrylate, diethylene glycol diacrylate, triethylene glycol diacrylate, tetraethylene glycol diacrylate, polyethylene glycol diacrylate, polypropylene glycol diacrylate, pentaerythritol triacrylate, pentaerythritol tetraacrylate, dipentaerythritol tetraacrylate, trimethylolpropane triacrylate, tetramethylolmethane tetraacrylate, oligo ester acrylate, N-methylol acryl amide, diacetone acryl amide, or epoxy acrylate; a methacrylic acid derivative such as methyl methacrylate, n-butyl methacrylate, 2-ethylhexyl methacrylate, lauryl methacrylate, allyl methacrylate, glycidyl methacrylate, benzyl methacrylate, dimethylaminomethyl methacrylate, 1,6-hexanediol dimethacrylate, ethylene glycol dimethacry late, triethylene glycol dimethacrylate, polyethylene glycol dimethacrylate, polypropylene glycol dimethacrylate, trimethylolethane trimethacrylate, trimethylolpropane trimethacrylate, or 2,2-bis (4-methacryloxypolyethoxyphenyl)propane; an allyl compound such as alltl glycidyl ether, diallyl phthalate or triallyl trimellitate; and radical polymerizable or crosslinkable monomers, oligomers or polymers described in S. Yamashita et al., "Crosslinking agent Handbook", Taisei Co., Ltd. (1981), K. Kato et al., "UV, EB Hardenable Handbook (Materials)", Kobunshi Kankokai (1985), Radotek Kenkyukai, "UV, EB Hardening Technology, Application and Market", pp. 79, CMC Co. Ltd. (1989), and E. Takiyama, "Polyester Resin Handbook", Nikkan Kyogyo Shinbunsha (1988). The content of the radical polymerizable compound in ink is preferably from 1 to 97% by weight, and more preferably from 30 to 95% by weight.

Listed as cation polymerizable photo-curable resins may be a monomer (of mainly an epoxy type) which undergoes polymerization due to cationic polymerization, a UV curing prepolymer of an epoxy type, and a prepolymer having at least two epoxy groups in one molecule. Listed as such prepolymers may be, for example, alicyclic polyepoxides, polyglycidyl esters of polybasic acids, polyglycidyl ethers of polyhydric alcohols, polyglycidyl ethers of polyoxyalkylene glycol, polyglycidyl ethers of aromatic polyols, hydrogenated compounds of polyglycidyl ethers of aromatic polyols, urethane polyepoxy compounds and epoxylated polybutadine. Types of these polymers may be employed individually or in combinations of two or more types.

In the polymerizable compound in the invention, a (meth) acrylate type monomer or prepolymer, an epoxy type monomer or prepolymer, or a urethane type monomer or prepolymer, is preferably used. More preferred examples of the polymerizable compound include 2-ethylhexyldiglycolacrylate, 2-hydroxy-3-phenoxypropyl acrylate, 2-hydroxybutyl acrylate, hydroxypivalic acid neopentylglycol acrylate, 2-acryloyloxyethylphtharic acid, methoxypolyethylene glycol acrylate, tetramethylolmethane triacrylate, 2-acryloyloxyethyl-2-hydroxyethylphtharic acid, dimethyloltricyclodecan diacrylate, ethoxylated phenyl acrylate, 2-acryloyloxyethylsuccinic acid, nonylphenol EO adduct acrylate, modified glycerin triacrylate, bisphenol A diglycidyl ether acrylic acid adduct, modified bisphenol A diacrylate, phenoxypolyethylene glycol acrylate, 2-acryloyloxyethylhexahydrophthalic acid, bisphenol A PO adduct diacrylate, bisphenol A EO adduct diacrylate, dipentaerythritol hexacrylate, pentaerythritol triacrylate, tolylenediisocyanateerethane prepolymer, lactone-modified flexible acrylate, butoxyethyl acrylate, propylene glycol diglycidyl ether acrylic acid adduct, pentaerythritol triacrylate hexamethylenediisocyanate urethane prepolymer, 2-hydroxyethyl acrylate, methoxydipropylene glycol acrylate, ditrimethylolpropane tetracrylate, pentaerythritol triacrylate hexamethylenediisocyanate urethane prepolymer, stearyl acrylate, isoamyl acrylate, isomyristyl acrylate, and isostearyl acrylate.

These acrylate compounds are less irritative or susceptible to skin (less poisoned), as compared to conventional polymerizable compound used in UV curable ink. These can lower a viscosity of ink, and can provide stable ink ejecting property, good polymerization sensitivity, and good adhesion to an ink recording medium. The content of the above compound in ink is from 20 to 95% by weight, preferably 50 to 95% by weight, and more preferably 70 to 95% by weight.

The monomers described above, if low molecular weight compounds, are less irritative, and have high reactivity, low viscosity, and excellent permeation or adhesion to the hydrophilic layer.

In order to improve sensitivity, bleeding and adhesion to the hydrophilic layer, a combined use of the monoacryltes described above and a polyfunctional acrylate monomer or polyfunctional acrylate oligomer having a molecular weight of not less than 400, and more preferably not less than 500 is preferred. As oligomers maintaining safety and further improving sensitivity, bleeding and adhesion to the hydrophilic layer, epoxyacrylate oligomer and urethaneacrylate oligomer are preferred.

A combine use of monoacrylates selected from the compounds described above and a polyfunctional acrylate monomer or oligomer is preferred in providing a flexible film, as well as high adhesion and film strength. The monoacrylates are preferably stearyl acrylate, isoamyl acrylate, isomyristyl acrylate, and isostearyl acrylate in providing high sensitivity and low shrinkage, preventing bleeding, minimizing ink odor of printed matter, and reducing cost.

Methacrylates are less irritative to skin than acrylates, but there are no substantial difference between those monomers with respect to susceptibility. Methacrylates have a sensitivity lower than acrylates, and are not suitable to use. However, methacrylate having high sensitivity and low susceptibility can be used. Alkoxyacrylates of the above monomers have problems with respect to sensitivity, bleeding, odor or an exposure source. It is preferred that the content of the alkoxyacrylates is less than 70 parts by weight, and the rest is another acrylate.

The ink used in the invention can contain other additives, as necessary.

When an electron beam or X ray is used as an exposure source, initiators are not needed, but when UV light, visible light or infrared light is used as a light source, radical polymerization initiators, auxiliary initiators, or sensitizing dyes are used according to the respective wavelength of light. The addition amount of these compounds is 1 to 10 parts by weight based on the weight of ink. The initiators include conventional initiators, but are selected from those soluble in the above polymerizable compounds. Examples of the initiators include xanthone or isoxanthone compounds, benzophenone compounds, quinone compounds, and phosphine oxides.

Ink can contain polymerization inhibitors in an amount of 200 to 20000 ppm in order to increase ink storage stability. It is preferred that the ink used in the invention is heated to 40 to 80° C. to lower its viscosity, and ejected. Accordingly, polymerization inhibitors are preferably added to ink in order to prevent clogging of an ink head nozzle.

Besides the above, a surfactant, a leveling agent, a matting agent, and a polyester resin, a polyurethane resin, a vinyl resin, an acryl resin, a rubber resin or waxes for adjusting film properties is optionally added to ink. In order to increase adhesion to a recording medium such as a polyolefin or PET film, a tackifier which does not inhibit polymerization is preferably added to ink. Its typical examples include a high molecular weight sticky polymer disclosed on pages 5 and 6 of Japanese Patent O.P.I. Publication No. 2001-49200 (a copolymer comprising an ester of (meth) acrylic acid with alcohol having an alkyl group having 1 to 20 carbon atoms, an ester of (meth)acrylic acid with an alicyclic alcohol having 3 to 14 carbon atoms, or an ester of (meth)acrylic acid with an aromatic alcohol having 6 to 14 carbon atoms), and low molecular weight stickiness providing resins having a polymerizable unsaturated bond.

In order to improve adhesion to the hydrophilic layer, addition of a minute amount of an organic solvent is effective. The addition of the organic solvent in an amount within the range which does not produce problems in solvent resistance or VOC is effective, and the content of the organic solvent in ink is from 0.1 to 5% and preferably from 0.1 to 3%.

As a means for minimizing lowering of sensitivity due to shielding effect of the colorant used, radical cation hybrid curable ink such as a combination of cation polymerization monomer and an initiator having a long lifetime can be used.

The composition of ink is determined to provide an ink viscosity of preferably from 7 to 30 mPa·s, and more preferably from 7 to 20 mPa·s at an ink ejecting temperature in view of ink ejecting property. The ink viscosity is preferably from 35 to 500 mPa·s, and more preferably from 35 to 200 mPa·s at 25° C. Increase of ink viscosity at room temperature can prevent ink from permeating into a porous layer of an ink recording medium, reduce an uncured monomer and malodor, minimize bleeding, and improve image quality. A viscosity less than 35 mPa·s does not minimize bleeding, and a viscosity exceeding 500 mPa·s causes problem of ink delivery.

The surface tension of ink is preferably from 200 to 300 $\mu$N/cm, and more preferably from 230 to 280 $\mu$N/cm. A surface tension less than 200 $\mu$N/cm has problem in bleeding or permeation, and a surface tension exceeding 300 $\mu$N/cm has problem in wettability.

In one of the ink image formation method in the invention, it is preferred in ink ejecting stability to eject ink whose viscosity is lowered by heating the above ink to 40 to 80° C., according to an ink jet method. Since the radiation curable ink generally has an ink viscosity higher than aqueous inks, its variation of viscosity due to temperature variation is great. The variation of viscosity has a great influence on size of ink droplets or ink ejecting speed, or image quality, and therefore, it is necessary that temperature of the ink is maintained as constant as possible. The temperature of the ink is in the range of a set temperature ±5° C., preferably a set temperature ±2° C., and more preferably a set temperature ±1° C. An ink jet recording apparatus has a means for stabilizing the ink temperature, and the sections in the apparatus where temperature is kept constant are pipe lines and members provided from ink tank (including an intermediate ink tank) to the ink nozzle for ejecting ink.

It is preferred that temperature is controlled according to ink flow rate or environmental temperature by plural temperature sensors provided at each pipe line. It is preferred that the head unit to be heated is thermally shielded or insulated without being influenced by temperature of the apparatus itself or environmental temperature. Further, it is preferred that the heating unit is low in heat content and thermally shielded from another section in order to shorten time necessary to heat or warming up time and reduce loss of heat energy.

As radiations used after ink ejecting, various radiations can be used, for example, UV light, electron beam, X ray, visible light, or infrared light. UV light is preferred in curing ability or cost. UV light sources include a mercury lamp, a metal halide lamp, an excimer lamp, and a UV laser, and an LED.

Fundamental radiation methods are disclosed in Japanese Patent O.P.I. Publication No. 60-132767, where light sources, which are provided on both sides of the head unit, are scanned by a shuttle method, radiation is carried out in a certain time after ink ejecting, and ink curing is completed employing another light source fixed. A method is disclosed in WO 9954415 in which optical fibers are used or collimated UV lights, which are projected on the mirror provided on the side of the head unit and reflected, are used for curing ejected ink. In the invention, these radiation methods can be used. It is preferred in the invention that radiation is carried out from the back of the head unit.

The method in which radiation is carried out from the back of the head unit can rapidly radiate ejected ink without using optical fibers or an expensive optical system. The radiation from the head unit back can prevent ink around ink nozzle from being cured by radiation reflected from an ink jet recording medium. The radiation source is preferably a cingulated source such that the radiation width projected on a recording medium is the same as one scanning.

Typically, a cingulated metal halide lamp tube or UV light lamp tube is preferred. The radiation lamp is fixed and unmovable, which can provide a cheap apparatus structure. In any radiation methods, two radiation sources, a first and second radiation sources are provided. The second radiation source is preferably used for completing ink curing, which contributes to improvement of adhesion between a first ink firstly ejected and a second ink ejected after the first ink, improvement of wettability of the second ink, and cost reduction of the radiation source.

It is preferred that the wavelength or exposure intensity of the first radiation source is different from that of the second radiation source. The radiation energy of the first radiation source is preferably less than that of the second radiation source. The radiation energy of the first radiation source is from 1 to 20%, preferably from 1 to 10%, and more preferably from 1 to 5% of the total energy radiated. The above radiation method can provide a desirable molecular weight distribution of the molecule after cured. When ink having an extremely low ink viscosity such as ink for ink jet recording is used, the method provides a markedly advantageous effect. When high energy radiation is carried out one time, it increases polymerization yield, but produces a polymer with a low molecular weight and cannot obtain high strength of the ink.

The wavelength of the first radiation is longer than that of the second radiation, where the first radiation cures the surface of ink ejected on a recording medium to prevent ink bleeding, and the second radiation cures ink closer to the recording medium, which the first radiation is difficult to reach, to improve ink adhesion to the recording medium.

The ink jet recording process in the invention is characterized in that the ink described above is heated to a constant temperature, ejected on an ink recording medium, and exposed to radiation in 0.01 to 0.5 seconds, preferably 0.01 to 0.3 seconds, and more preferably 0.01 to 0.15 seconds after the ink is ejected on the recording medium. Shortening time from when the ink is ejected on the medium to when the ink is exposed to radiation can prevent ink from bleeding before the ink is hardened. Even when a porous recording medium is used, the method can expose the ink close to the medium, which the radiation is difficult to reach, before the ink is cured, which can reduce the residual unreacted monomer, and malorder. This can provide a great synergic effect in combination with the ink used in the invention. Particularly, ink having a viscosity at 25° C. of from 35 to 500 Pa·s can obtain a great effect. The method described above can keep a dot size of ink constant, which is ejected on various recording media which are different in the surface wettability, resulting in high quality images.

The head unit is comprised of an ink jet nozzle head, an ink supply system, ink, a temperature control system of a head or ink, and a controlling board. In the method in which radiation is carried out from the back of the head unit, projected area of the radiation on a recording medium is preferably less, which the first radiation is effectively carried out.

EXAMPLES

The invention will be detailed according to the following examples, but is not limited thereto.

(Preparation of Substrates 1, 2, and 3)

a. Substrate 1

A first subbing layer an a second subbing layer were coated in that order on both surfaces of a 50 μm thick PET film according to the following procedures to obtain a substrate 1.

<First Subbing Layer Coating Solution>

| | |
|---|---|
| Acryl latex particles (n-butyl acrylate/t-butyl acrylate/styrene/hydroxyethyl methacrylate (=28/22/25/25) copolymer) | 36.9 g |
| Surfactant (A) | 0.36 g |
| Hardener (a) | 0.98 g |

Distilled water was added to the above composition to make 1,000 ml to obtain a first subbing layer coating solution.

The first subbing layer coating solution was coated on the film described above to form a first subbing layer. The resulting first subbing layer surface was corona discharged and the following second coating solution was coated onto the discharged surface by an air knife method at 35° C. and 22% RH to obtain a dry thickness of 0.1 μm, and further dried at 140° C. for 2 minutes to form a second subbing layer with. corona discharged, and the second subbing layer coating solution was coated onto the discharged surface by a wire bar at 20° C. and 55% RH to obtain a first subbing layer with a dry thickness of 0.4 μm, and dried at 140° C. for 2 minutes.

<Second Subbing Layer Coating Solution>

| | |
|---|---|
| Gelatin | 9.6 g |
| Surfactant (A) | 0.4 g |
| Hardener (b) | 0.1 g |

Distilled water was added to the above composition to make 1,000 ml to obtain a second subbing layer coating solution.

Surfactant (A)

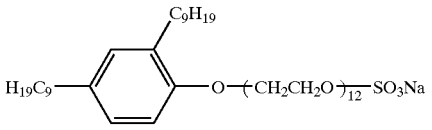

Hardener (a)

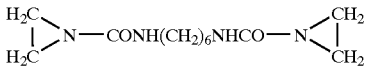

Hardener (b)

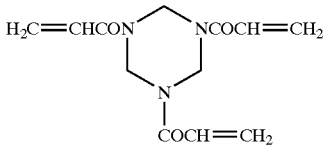

b. Substrate 2

A 50 μm thick PET film (HS74 produced by Teijin Co., Ltd.) with a subbing layer for an aqueous coating liquid was employed as substrate 2.

A 50 μm thick polyethylene terephthalate film (HS 74 produced by Teijin Co., Ltd.) with a subbing layer for an aqueous coating liquid was employed as substrate 1.

c. Substrate 3

A substrate 3 was prepared in the same manner as in substrate 1, except that a 20 μm thick PET film was used instead of the PET film used in substrate 1.

(Preparation of Each Coating Solution)

<Preparation of Hydrophilic Layer Coating Solutions 1 and 2>

The materials as shown in Table 2 were sufficiently mixed while stirring, employing a homogenizer, and filtered to obtain hydrophilic layer coating solutions 1 and 2 each having a solid content of 20.00% by weight.

TABLE 2

| Materials used | Hydrophilic layer coating solution 1 (parts by weight) | Hydrophilic layer coating solution 2 (parts by weight) |
|---|---|---|
| *1 | 17.20 | 15.87 |
| *2 | 38.70 | 35.70 |
| *3 | 5.00 | 5.00 |
| *4 | 8.00 | 8.00 |
| *5 | 5.00 | 5.00 |
| *6 | 1.00 | 1.00 |
| *7 | 2.40 | 2.40 |
| *8 | 2.00 | |
| *9 | | 3.00 |
| Pure water | 20.70 | 24.03 |

*1: Colloidal silica (alkali type): Snowtex S (solid 30% by weight, produced by Nissan Kagaku Co., Ltd.)

*2: Necklace shaped colloidal silica (alkali type): Snowtex PSM (solid 20% by weight, produced by Nissan Kagaku Co., Ltd.)

*3. Cu—Fe—Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40.5% by weight (including 0.5% by weight of dispersant)}

*4. Layer structural clay mineral particles: Montmorillonite Mineral Colloid MO gel prepared by vigorously stirring montmorillonite Mineral Colloid MO; gel produced by Southern Clay Products Co., Ltd. (average particle size: 0.1 μm) in water in a homogenizer to give a solid content of 5% by weight

*5. Aqueous 4% by weight sodium carboxymethyl cellulose solution (Reagent produced by Kanto Kagaku Co., Ltd.)

*6. Aqueous 10% by weight sodium phosphate.dodecahydrate solution (Reagent produced by Kanto Kagaku Co., Ltd.)

TABLE 2-continued

| Materials used | Hydrophilic layer coating solution 1 (parts by weight) | Hydrophilic layer coating solution 2 (parts by weight) |
|---|---|---|

*7: Porous metal oxide particles Silton AMT 08 (porous aluminosilicate particles having an average particle size of 0.6 μm, produced by Mizusawa Kagaku Co., Ltd.)
*8: Porous metal oxide particles Silton JC 20 (porous aluminosilicate particles having an average particle size of 2 μm, produced by Mizusawa Kagaku Co., Ltd.)
*9: Porous metal oxide particles Silton JC 30 (porous aluminosilicate particles having an average particle size of 3 μm, produced by Mizusawa Kagaku Co., Ltd.) (Preparation of under layer coating liquid)

<Preparation of Under Layer Coating Solution>

The materials as shown in Table 3 were sufficiently mixed while stirring, employing a homogenizer, and filtered to obtain an under layer coating solution having a solid content of 20.00% by weight.

TABLE 3

| Materials used | Under layer coating solution (parts by weight) |
|---|---|
| Colloidal silica (alkali type): Snowtex XS (solid 20% by weight, produced by Nissan Kagaku Co., Ltd.) | 74.50 |
| Cu—Fe—Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40.5% by weight (including 0.5% by weight of dispersant)} | 3.50 |
| Layer structural clay mineral particles: Montmorillonite Mineral Colloid MO gel prepared by vigorously stirring montmorillonite Mineral Colloid MO; gel produced by Southern Clay Products Co., Ltd. (average particle size: 0.1 μm) in water in a homogenizer to give a solid content of 5% by weight | 8.00 |
| Aqueous 4% by weight sodium carboxymethyl cellulose solution (Reagent produced by Kanto Kagaku Co., Ltd.) | 5.00 |
| Aqueous 10% by weight sodium phosphate.dodecahydrate solution (Reagent produced by Kanto Kagaku Co., Ltd.) | 1.00 |
| Porous metal oxide particles Silton JC 40 (porous aluminosilicate particles having an average particle size of 4 μm, produced by Mizusawa Kagaku Co., Ltd.) | 3.00 |
| Pure water | 5.00 |

<Preparation of Ink Repellent Layer Coating Solution>

The materials as shown in Table 4 were sufficiently mixed while stirring, and filtered to obtain an ink repellent layer coating solution.

TABLE 4

| Materials used | Ink repellent layer coating solution (parts by weight) |
|---|---|
| Polydimethyl siloxane having hydroxyl groups in both ends of the polymer | 93.00 |
| 3-[N-allyl-N-(2-aminoethyl)] aminopropyltrimethoxy-siolane | 6.30 |
| Dibutyltin dilaurate | 0.70 |
| Isopar A (produced by Exon Chemical Co., Ltd.) | 90.00 |

<Preparation of Ablation Layer Coating Solution>

The materials as shown in Table 5 were sufficiently mixed while stirring, and filtered to obtain an ablation layer coating solution having a solid content of 8.00% by weight.

TABLE 5

| Materials used | Ablation layer coating solution (parts by weight) |
|---|---|
| Colloidal silica (alkali type): Snowtex S (solid 30% by weight, produced by Nissan Kagaku Co., Ltd.) | 10.67 |
| Necklace shaped colloidal silica (alkali type): Snowtex PSM (solid 20% by weight, produced by Nissan Kagaku Co., Ltd.) | 8.00 |
| Aqueous carbon black dispersion SD9020 (solid content: 20% by weight, produced by Dainippon Ink Co., Ltd.) | 0.70 |
| Carnauba wax emulsion A118 (having a solid content of 40% by weight, the wax having an average particle size of 0.3 μm, a melting viscosity at 140° C. of 8 cps, a softening point of 65° C., and a melting point of 80° C., produced by GifuCerac Co., Ltd.) | 2.00 |
| Pure water | 71.33 |

<Preparation of Image Formation Layer Coating Solution>

The materials as shown in Table 6 were sufficiently mixed while stirring, and filtered to obtain an image formation layer coating solution.

TABLE 6

| Materials used | Ablation layer coating solution (parts by weight) |
|---|---|
| Aqueous 5% by weight solution of disaccharide trehalose powder (Trehaose, mp. 97° C., produced by Hayashihara Shoji Co., Ltd.) | 35.00 |
| Carnauba wax emulsion A118 (having a solid content of 40% by weight, the wax having an average particle size of 0.3 μm, a melting viscosity at 140° C. of 8 cps, a softening point of 65° C., and a melting point of 80° C., produced by GifuCerac Co., Ltd.) | 65.00 |

<Preparation Coating Solutions A Through D for Back Coat Layer or Plate Cylinder Surface Coating>

The materials as shown in Table 7 were sufficiently mixed while stirring, and filtered to obtain coating solutions A through D for a back coat layer or a plate cylinder surface coating, each having a solid content of 15.00% by weight.

TABLE 7

| | Coating solutions | | | |
|---|---|---|---|---|
| Materials used | A (Parts by weight) | B (Parts by weight) | C Parts by weight | D Parts by weight |
| *11 | 30.00 | 26.25 | 24.75 | 26.25 |
| *12 | 23.66 | 21.55 | 14.79 | 16.06 |
| *3 | | 3.75 | 3.75 | 3.75 |
| *4 | 5.40 | 5.40 | 5.40 | 5.40 |

TABLE 7-continued

| Materials used | Coating solutions A (Parts by weight) | B (Parts by weight) | C Parts by weight | D Parts by weight |
|---|---|---|---|---|
| *9 | 0.30 | 0.30 | | |
| *10 | | | 3.00 | |
| *11 | | | | 2.25 |
| *12 | 3.00 | 3.00 | 3.00 | 3.00 |
| Pure water | 37.64 | 39.75 | 45.31 | 43.29 |

*11: Colloidal silica (alkali type): Snowtex XS (solid 20% by weight, produced by Nissan Kagaku Co., Ltd.)
*12: Acryl emulsion AE986A (Tg: 2° C., solid 35.5% by weight, produced by JSR Co., Ltd.)
*3. Cu—Fe—Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40.5% by weight (including 0.5% by weight of dispersant)}
*4. Layer structural clay mineral particles: Montmorillonite Mineral Colloid MO gel prepared by vigorously stirring montmorillonite Mineral Colloid MO; gel produced by Southern Clay Products Co., Ltd. (average particle size: 0.1 μm) in water in a homogenizer to give a solid content of 5% by weight
*9: Porous metal oxide particles Silton JC 30 (porous aluminosilicate particles having an average particle size of 3 μm, produced by Mizusawa Kagaku Co., Ltd.) (Preparation of under layer coating liquid)
*10: Porous metal oxide particles Silton JC 40 (porous aluminosilicate particles having an average particle size of 4 μm, produced by Mizusawa Kagaku Co., Ltd.)
*11: Porous metal oxide particles Silton JC 50 (porous aluminosilicate particles having an average particle size of 5 μm, produced by Mizusawa Kagaku Co., Ltd.)

TABLE 7-continued

| Materials used | Coating solutions A (Parts by weight) | B (Parts by weight) | C Parts by weight | D Parts by weight |
|---|---|---|---|---|

*12: 1% by weight solution of silicon-containing surfactant FZ2162 (produced by Nippon Unicar Co., Ltd.)

The first layer coating solution, second layer coating solution, and third layer coating solution, as shown in Table 8, were coated in that order on the substrate as shown in Table 8 employing a wire bar to give layers with a dry thickness shown in Table 8, and the back coat layer as shown in Table 8 was coated on the surface of the substrate opposite the surface of the substrate, on which the first, second and third layers were coated, employing a wire bar to give a back coat layer with a dry thickness shown in Table 8. Thus, printing plate precursor samples 1 through 6 were obtained.

The image formation layer and the back coat layer after coated were dried at 55° C. for 3 minutes, and layers other than those at 80° C. for 3 minutes.

Light transmittance of an 830 nm light of each sample was measured, and is shown in Table 8.

TABLE 8

| | Sample No. 1 | 2 | 3 | 4 | 5 | 6 |
|---|---|---|---|---|---|---|
| | Substrate No. 1 | 2 | 3 | 4 | 5 | 6 |
| First layer coating solution | HLS-1 | HLS-1 | ULS | ULS | ALS | ALS |
| First layer dry thickness ($g/m^2$) | 3.0 | 3.0 | 2.0 | 2.0 | 1.0 | 3.0 |
| Second layer coating solution | ILS | ILS | HLS-2 | HLS-2 | IRLS | IRLS |
| Second layer dry thickness ($g/m^2$) | 0.7 | 0.7 | 1.0 | 1.0 | 0.5 | 0.05 |
| Third layer coating solution | None | None | ILS | ILS | None | None |
| Third layer dry thickness ($g/m^2$) | — | — | 0.7 | 0.7 | — | — |
| Back coat layer coating solution | None | Solution B | Solution A | Solution c | Solution B | Solution B |
| Back coat layer dry thickness ($g/m^2$) | — | 3.0 | 3.0 | 2.0 | 3.0 | 3.0 |
| Transmittance at 830 nm (%) | 60 | 30 | 40 | 50 | 20 | 20 |
| Roughness Ra of rear surface (μm) | 0.01 | 0.15 | 0.15 | 0.30 | 0.15 | 0.15 |

In the above Table,
HLS-1: Hydrophilic layer coating solution 1,

TABLE 8-continued

| Sample No. | | | | | |
|---|---|---|---|---|---|
| 1 | 2 | 3 | 4 | 5 | 6 |
| Substrate No. | | | | | |
| 1 | 2 | 3 | 4 | 5 | 6 |

ULS: Under layer coating solution,
ALS: Ablation layer coating solution,
ILS: Image formation layer coating solution,
HLS-2: Hydrophilic layer coating solution 2,
IRLS: Ink repellent layer coating solution Regarding samples having an image formation layer, aging at 60° C. for 24 hours had been carried out before the image formation layer was coated, and aging at 40° C. for 48 hours was carried out after the image formation layer was coated. Regarding other samples, aging at 60° C. for 24 hours had been carried out after all the coating layers were coated. The surface roughness Ra of the rear surface of the substrate opposite the hydrophilic layer, under layer, ablation layer or image formation layer in each sample was measured. The measurement was carried out at a magnification of 40 employing a non-contact surface roughness measuring apparatus RST Plus, manufactured by WYKO Co., Ltd., wherein a 1.0 nm thick platinum-rhodium layer had been deposited on the surface of each sample. The results are shown in Table 8.

(Preparation of Plate Cylinder Covering Plates)

<Preparation of Plate Cylinder Covering Plate 1>

A 0.24 mm thick aluminum plate (material 1050) was degreased at 50° C. for 30 seconds in a 2% sodium hydroxide solution, washed with water, immersed at 30° C. for 10 seconds in a 2.0% nitric acid solution to neutralize, and then washed with water. The resulting aluminum plate was electrolytically surface-roughened at 30° C. in a 2.0 weight % nitric acid solution employing a sine wave of a peak current density of 60 A/dm$^2$ and a positive electric quantity of 500 C. The resulting plate was immersed at 30° C. for 20 seconds in a 1% sodium hydroxide solution, washed with water, and then anodized at 25° C. at 20V in a 20% by weight sulfuric acid solution to form an anodization film of a thickness of 0.5 g/dm$^2$. The average surface roughness Ra of the resulting plate, measured according to the method described above, was 0.7 $\mu$m.

The resulting plate was cut into a size capable of being mounted on the plate cylinder of a printing press, and orifices with a diameter of 1 mm were provided at intervals of about 1 cm along a position 5 mm inside from the four ends of the plate. Thus, a plate cylinder covering plate 1 was obtained.

<Preparation of Plate Cylinder Covering Plate 2>

A 0.24 mm thick aluminum plate (material 1050) was degreased at 50° C. for 30 seconds in a 2% sodium hydroxide solution, washed with water, and dried. Subsequently, the coating solution B described in Table 7 was coated on the resulting plate employing a wire bar, and dried at 80° C. for 3 minutes to give a layer with a dry thickness of 3 g/m$^2$. After that, the resulting plate was processed in the same manner as above to obtain a plate cylinder covering plate 2.

The average surface roughness Ra of the plate cylinder covering plate 2 was 0.15 $\mu$m.

<Preparation of Plate Cylinder Covering Plate 3>

A plate cylinder covering plate 3 was prepared in the same manner as in the plate cylinder covering plate 2 above, except that the coating solution D described in Table 7 was used and coated to give a layer with a dry thickness of 0.35 g/m$^2$.

The average surface roughness Ra of the plate cylinder covering plate 3 was 0.15 $\mu$m.

Example 1

The printing plate precursor sample 2 described in Table 8 was cut into the same size as the plate cylinder covering plate 1, and was superposed on the roughened surface of the plate cylinder covering plate 1 so that the back coat layer of the sample 2 faced the roughened surface of the plate cylinder covering plate 1. Herein, a 2 mm wide double coating adhesive tape was provided over the entire length of one edge of the covering plate and the entire length of the other edge parallel with the one edge (the both edges are portions corresponding to the gripper margins of a printing press), and the covering plate 1 and the sample 2 were temporarily adhered to each other.

The adhered material was wound around a drum of an exposure apparatus so that the covering plate 1 faced the drum, and one edge of the material and the other edge parallel with the one edge were caused to adhere to the drum through adhesive tape. The covering plate 1 was further fixed by application of suction on the drum having the orifices in the drum surface, and at the same time, the sample 2 was fixed onto the covering plate 2 in the presence of the grooves of the drum, which was positioned right under the orifices of the covering plate 2.

The printing plate precursor sample 2 was imagewise exposed to an infrared laser (having a wavelength of 830 nm and a beam spot diameter of 18 $\mu$m) brought into focus on the sample surface at an exposure energy of 300 mJ/cm$^2$, at a resolving degree of 4,000 dpi and at a screen line number of 175 to form an image. The term, "dpi" shows the number of dots per 2.54 cm. Exposure was carried out to obtain a 50% dot area at portions 20 mm or more inside from each of the four edges of the printing plate precursor sample.

After exposure, the adhered material, in which the covering plate 1 and the sample 2 were temporarily adhered to each other, was dismounted from the drum, and it proved that the sample 2 was firmly fixed to the covering plate 1.

The exposed adhered material was mounted on a plate cylinder of a printing press, DAIYA 1F-1 produced by Mitsubishi Jukogyo Co., Ltd., in the same manner as in a conventional way. Printing was carried out employing a coated paper, dampening water a 2% by weight solution of Astromark 3 (produced by Nikken Kagaku Kenkyusyo Co., Ltd.), and printing ink (Toyo King Hyecho M Magenta, produced by Toyo Ink Manufacturing Co.).

No displacement of the planographic printing plate precursor sample was observed even after 10,000 copies were printed.

After printing, the adhered material, in which the covering plate 1 and the sample 2 were temporarily adhered to each other, was dismounted from the plate cylinder and the sample 2 was removed from the covering plate 1. No residues were observed on the surface of the covering plate 1.

Example 2

Image formation and printing were carried out in the same manner as in Example 1, except that the planographic printing plate precursor sample 3 and covering plate 3 were used.

No displacement of the planographic printing plate precursor sample 3 was observed even after 10,000 copies were printed.

After printing, the sample 3 was removed from the covering plate 3. No residues were observed on the surface of the covering plate 3.

Example 3

Image formation and printing were carried out in the same manner as in Example 1, except that the planographic printing plate precursor sample 4 and covering plate 2 were used.

No displacement of the planographic printing plate precursor sample 4 was observed even after 10,000 copies were printed.

After printing, the sample 4 was removed from the covering plate 2. No residues were observed on the surface of the covering plate 2.

Example 4

An adhered material was prepared in the same manner as in Example 1, except that a planographic printing plate precursor sample 5 was used instead of sample 2. The adhered material was wound around a drum of an exposure apparatus and fixed in the same manner as in Example 1.

The printing plate precursor sample 5 was subjected to first exposure employing laser beams (having a wavelength of 830 nm and a beam spot diameter of 18 $\mu$m) brought into focus on the sample surface at an exposure energy of 200 mJ/cm$^2$ at a resolving degree of 2400 dpi to form a solid image. The term, "dpi" shows the number of dots per 2.54 cm. Exposure was carried out to obtain a solid image at portions 10 mm or more inside from each of the four edges of the printing plate precursor sample.

After the first exposure, the surface of the sample 5 was observed but no image formation due to ablation was observed.

The printing plate precursor sample 2 was subjected to second exposure employing the laser beams brought into focus on the planographic printing plate precursor sample surface at an exposure energy of 500 mJ/cm$^2$, at a resolving degree of 2,400 dpi and at a screen line number of 175 to form an image. Exposure was carried out to obtain an image with a 2 to 90% dot area and a thin line image at portions 20 mm or more inside from each of the four edges of the printing plate precursor sample.

After the second exposure, the ink repellent layer surface was wiped with water impregnated cloth to remove ablated materials remaining on the exposed portions and scattering to its surrounding area.

After the second exposure, the adhered material, in which the covering plate 1 and the sample 5 were temporarily adhered to each other, was dismounted from the drum, and it proved that the sample 5 was firmly fixed to the covering plate 1.

The exposed adhered material was mounted on a plate cylinder of a printing press, DAIYA 1F-1 produced by Mitsubishi Jukogyo Co., Ltd., in the same manner as in a conventional way. Printing was carried out employing a coated paper, and printing ink for waterless printing (Aqualess Echo M Magenta, produced by Toyo Ink Manufacturing Co.).

No displacement of the planographic printing plate precursor sample 5 was observed even after 10,000 copies were printed.

After printing, the adhered material, in which the covering plate 1 and the sample 5 were temporarily adhered to each other, was dismounted from the plate cylinder and the sample 5 was removed from the covering plate 1. No residues were observed on the surface of the covering plate 1.

Effects of the Invention

The present invention provides a planographic printing plate precursor having a substrate with a reduced thickness, which is capable of fixing on a plate cylinder of a printing press without displacement and a method for fixing the planographic printing plate recursor on a plate cylinder of a printing press.

What is claimed is:

1. A method of fixing a planographic printing plate precursor on a plate cylinder of a printing press capable of forming an image on the plate cylinder, the surface of the plate cylinder having orifices or grooves to obtain reduced pressure by suction, existing only at a portion corresponding to the peripheral portion of an image formation region in the planographic printing plate precursor, the method comprising the steps of:

mounting the planographic printing plate precursor on the plate cylinder; and applying suction to the planographic printing plate precursor through the orifices or grooves to fix the planographic printing plate precursor on the surface of the plate cylinder; and wherein the planographic printing plate precursor is a planographic printing plate precursor comprising a flexible substrate and provided thereon, an ink repellent layer or a hydrophilic layer, at least one layer on the ink repellent layer or the hydrophilic layer side containing a light heat conversion material, wherein a back coat layer containing a light heat conversion material is provided on the surface of the flexible substrate opposite the ink repellent layer or the hydrophilic layer, and is an outermost layer and wherein the planographic printing plate precursor has an 830 nm light transmittance of not less than 10%.

2. The method of claim 1, wherein the peripheral portion is outside register marks.

3. The method of claim 1, wherein the plate cylinder surface is comprised of a detachable material.

* * * * *